US010166159B2

(12) United States Patent
Suzuki et al.

(10) Patent No.: US 10,166,159 B2
(45) Date of Patent: Jan. 1, 2019

(54) CARE ROBOT

(71) Applicant: FUJI CORPORATION, Chiryu (JP)

(72) Inventors: Jun Suzuki, Kasugai (JP); Joji Isozumi, Nagakute (JP); Kazuaki Mori, Anjo (JP); Nobuyuki Nakane, Toyota (JP); Hideaki Nomura, Toyota (JP)

(73) Assignee: FUJI CORPORATION, Chiryu (JP)

( * ) Notice: Subject to any disclaimer, the term of this patent is extended or adjusted under 35 U.S.C. 154(b) by 24 days.

(21) Appl. No.: 14/766,661

(22) PCT Filed: Feb. 7, 2013

(86) PCT No.: PCT/JP2013/052890
§ 371 (c)(1),
(2) Date: Aug. 7, 2015

(87) PCT Pub. No.: WO2014/122752
PCT Pub. Date: Aug. 14, 2014

(65) Prior Publication Data

US 2015/0359694 A1 Dec. 17, 2015

(51) Int. Cl.
*A61G 7/14* (2006.01)
*A61G 7/10* (2006.01)
*A61G 5/14* (2006.01)

(52) U.S. Cl.
CPC ..... *A61G 7/1019* (2013.01); *A61G 5/14* (2013.01); *A61G 7/1046* (2013.01);
(Continued)

(58) Field of Classification Search
CPC ..... A61G 2200/34; A61G 2200/36; A61G 2200/52; A61G 5/14; A61G 7/1019; A61G 7/1046; B25J 11/009
See application file for complete search history.

(56) References Cited

U.S. PATENT DOCUMENTS 8,375,484 B2 2/2013 Ota et al.
9,844,481 B2 * 12/2017 Tsusaka ..... A61G 7/10
(Continued)

FOREIGN PATENT DOCUMENTS

EP 2 813 203 A1 12/2014
JP 9 66082 3/1997
(Continued)

OTHER PUBLICATIONS

U.S. Appl. No. 14/766,633, filed Aug. 7, 2015, Isozumi, et al.
(Continued)

*Primary Examiner* — Dale Moyer
(74) *Attorney, Agent, or Firm* — Oblon, McClelland, Maier & Neustadt, L.L.P.

(57) ABSTRACT

A care robot that assists a standing-upright motion or a sitting motion of a care receiver without making the care receiver uncomfortable. In the care robot, a standing-upright trajectory, along which a movement control portion of a care receiver moves, is set so a center of gravity of the care receiver is in a range of the soles of both feet between a point in time early after the start of a standing-upright motion and an end time point of the standing-upright motion of the care receiver. A sitting trajectory is set so the center of gravity of the care receiver is out of the range of the soles of both feet from a point in time early after the start of a sitting motion of the care receiver, and moves toward a predetermined sitting position of the care receiver.

10 Claims, 16 Drawing Sheets

(52) U.S. Cl.
CPC ..... *A61G 2200/34* (2013.01); *A61G 2200/36* (2013.01); *A61G 2200/52* (2013.01)

(56) References Cited

U.S. PATENT DOCUMENTS

| | | | | |
|---|---|---|---|---|
| 2011/0056019 | A1* | 3/2011 | Altena | A61G 5/14 5/87.1 |
| 2011/0277235 | A1* | 11/2011 | Okumatsu | A61G 7/1017 5/83.1 |
| 2012/0142497 | A1 | 6/2012 | Ishii et al. | |
| 2014/0100491 | A1* | 4/2014 | Hu | A61H 3/008 601/27 |
| 2014/0150806 | A1* | 6/2014 | Hu | A61B 5/0002 128/870 |
| 2015/0005938 | A1 | 1/2015 | Suzuki et al. | |
| 2015/0099608 | A1 | 4/2015 | Ishii et al. | |
| 2015/0359691 | A1* | 12/2015 | Isozumi | A61G 5/04 180/19.1 |

FOREIGN PATENT DOCUMENTS

| | | | |
|---|---|---|---|
| JP | 2008-48981 | A | 3/2008 |
| JP | 2010-142562 | A | 7/2010 |
| JP | 2011-19571 | A | 2/2011 |
| JP | 3166214 | U | 2/2011 |
| JP | 2012 30077 | | 2/2012 |
| JP | 2012-120638 | A | 6/2012 |
| WO | WO 2009/126040 | A2 | 10/2009 |

OTHER PUBLICATIONS

International Search Report dated May 14, 2013 in PCT/JP2013/052890 Filed Feb. 7, 2013.

Extended European Search Report dated Sep. 6, 2016 in Patent Application No. 13874310.9.

Combined Chinese Office Action and Search Report dated Aug. 15, 2016 in Patent Application No. 201380072426.1 (with partial English translation and English translation of categories of cited documents).

Japanese Office Action dated Jan. 31, 2017 in patent application No. 2014-560571 (English translation only).

* cited by examiner

FIG. 13

| X-Y COORDINATES | | | FIRST ANGLE ($\theta$a) | FIRST ANGULAR VELOCITY ($\omega$a) | SLIDE AMOUNT (L) | SLIDE VELOCITY (V) | SECOND ANGLE ($\theta$b) | SECOND ANGULAR VELOCITY ($\omega$b) |
|---|---|---|---|---|---|---|---|---|
| Xa1 | Ya1 | $\alpha$1 | $\theta$a1 | $\omega$a1 | L1 | V1 | $\theta$b1 | $\omega$b1 |
| Xa2 | Ya2 | $\alpha$2 | $\theta$a2 | $\omega$a2 | L2 | V2 | $\theta$b2 | $\omega$b2 |
| · | · | · | · | · | · | · | · | · |
| · | · | · | · | · | · | · | · | · |
| · | · | · | · | · | · | · | · | · |
| Xan | Yan | $\alpha$n | $\theta$an | $\omega$an | Ln | Vn | $\theta$bn | $\omega$bn |

CARE ROBOT

TECHNICAL FIELD

The present disclosure relates to a care robot which assists a movement of a care receiver.

BACKGROUND ART

As a type of care robot, a care robot disclosed in PTL 1 is known. As illustrated in FIG. 3 of PTL 1, in the care robot, if a sitting user drives an electric motor 17 in a predetermined direction by gripping and operating one operation handle 21*a* while respective extension portions 19*a* of a support member 19 in which a movable member 11 is moved to a downward limit position with respect to a support section 7 are held under the user's arms, the movable member 11 is moved upward with respect to the support section 7 by a feed screw 15 rotating in a desired direction. In this manner, the user is lifted and allowed to stand upright by the support member 19 moving upward.

Then, if the user is allowed to stand upright in a position where the user can grip the respective extension portions 19*a*, the user stops gripping and operating the operation handle 21*a*, and stops the upward movement of the movement member 11. In this state, the user can walk while gripping the respective extension portions 19*a* and moving a traveling member 3 in a desired direction.

In addition, as another type of care robot, a care robot disclosed in PTL 2 is known. As disclosed in PTL 2, the care robot can assist a user to switch between a non-upright position (seating position) and an upright position.

CITATION LIST

Patent Literature

PTL 1: JP-A-09-066082
PTL 2: JP-A-2012-030077

BRIEF SUMMARY

Technical Problem

According to the care robot disclosed in PTL 1 described above, the user is lifted and allowed to stand upright by the support member 19 moving upward. In addition, the care robot disclosed in PTL 2 described above can assist a user to switch between the non-upright position and the upright position. However, when any of these care robots assists a standing-upright motion and a sitting motion of the care receiver, the care receiver may be uncomfortable due to a standing-upright trajectory and a sitting trajectory along which the care receiver stands upright and sits.

The present disclosure is made in order to solve the above-described problem, and an object of the present disclosure is to provide a care robot that assists a standing-upright motion and a sitting motion of a care receiver without making the care receiver uncomfortable.

Solution to Problem

In order to solve the problem, according to an aspect of the present disclosure, there is provided a care robot including a holding section configured to assist a standing-upright motion and a sitting motion of a care receiver by supporting apart of the body of the care receiver, in which when the sitting care receiver stands upright with the support of the holding section, a standing-upright trajectory, along which a movement control portion of the care receiver moves, is set such that a center of gravity of the care receiver is present in the range of the soles of both feet between a point in time early after the start of the standing-upright motion and an end time point of the standing-upright motion of the care receiver, and in which when the standing care receiver sits with the support of the holding section, a sitting trajectory, which is different from the standing-upright trajectory, and along which the movement control portion of the care receiver moves, is set such that the center of gravity of the care receiver is present out of the range of the soles of both feet from a point in time early after the start of the sitting motion of the care receiver, and moves toward a predetermined sitting position of the care receiver.

BRIEF DESCRIPTION OF DRAWINGS

FIG. 13 is a table illustrating a relationship between X-Y coordinates and robot coordinates.

DETAILED DESCRIPTION

Figure 1:
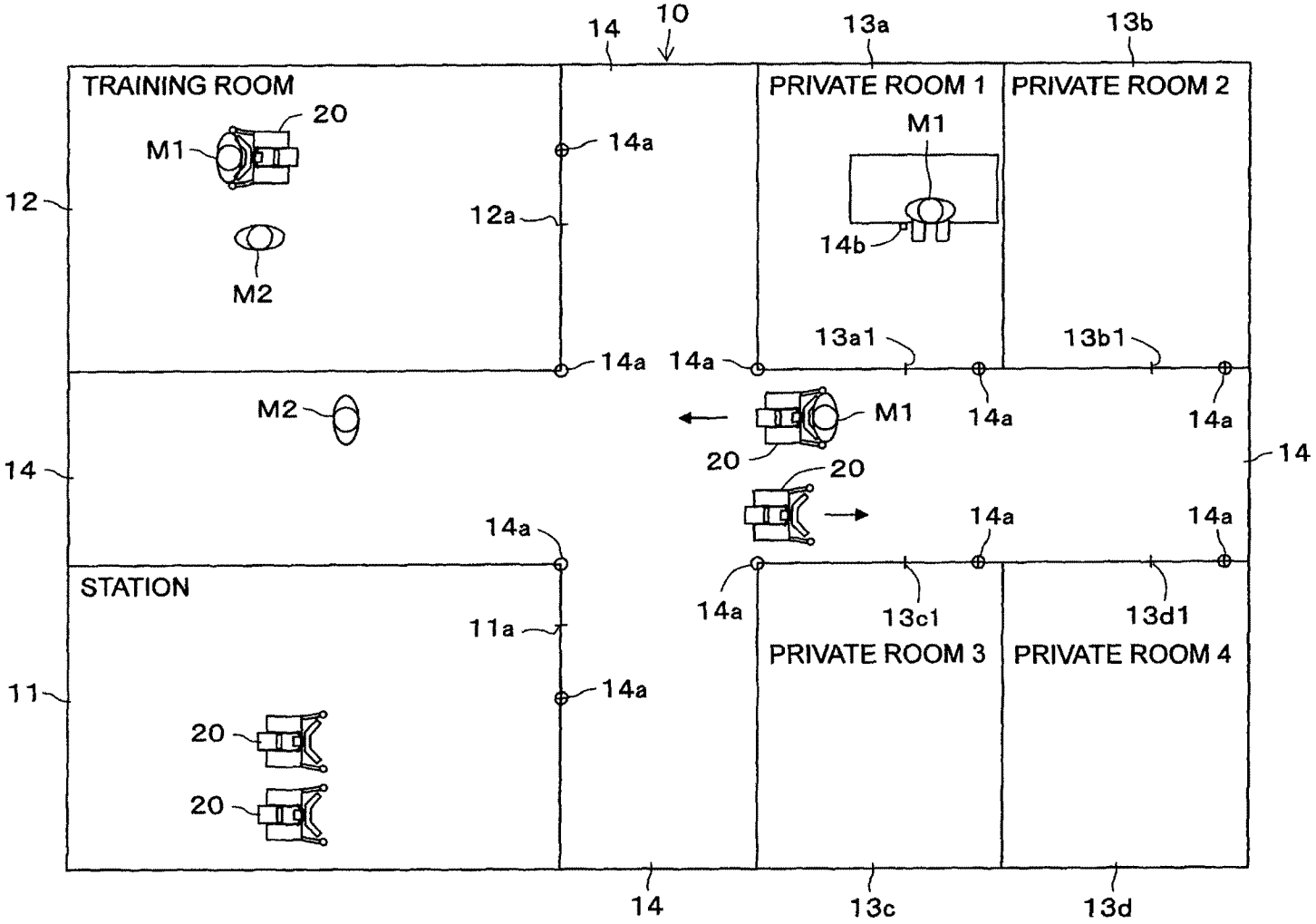
FIG. 1 is a schematic diagram illustrating a scheme of a care center in which care robots are arranged according to an embodiment of the present disclosure.

Hereinafter, an embodiment of a care robot according to the present disclosure will be described. FIG. 1 is a schematic view illustrating a scheme of a care center 10 where care robots 20 are arranged. The care center 10 has a station 11, a training room 12, and respective private rooms 13*a* to 13*d*. The care center 10 is a residential area where persons live. The persons living in the care center 10 are care receivers M1 who require care and care givers M2 who take care of the care receivers M1.

As illustrated in FIG. 1, the station 11 is an office of the care givers M2, and serves as a base where the care robots 20 are on standby or charged. The care robot 20 is allowed to move in the residential area where the persons live, and is moved in the residential area by driving left and right drive wheel motors 21*g* and 21*h* serving as drive sources. The training room 12 is a room where the care receivers M1 are in training or rehabilitation. The respective private rooms are rooms 13*a* to 13*d* where the care receivers M1 live.

The station 11, the training room 12, and the respective private rooms 13*a* to 13*d* have respective entrances/exits 11*a*, 12*a*, and 13*a*1 to 13*d*1. The respective entrances/exits 11*a*, 12*a*, and 13*a*1 to 13*d*1 are connected to one another via a corridor 14. In FIG. 1, arrows in the vicinity of the care robots 20 indicate the travelling directions of the care robots 20.

Figure 2:
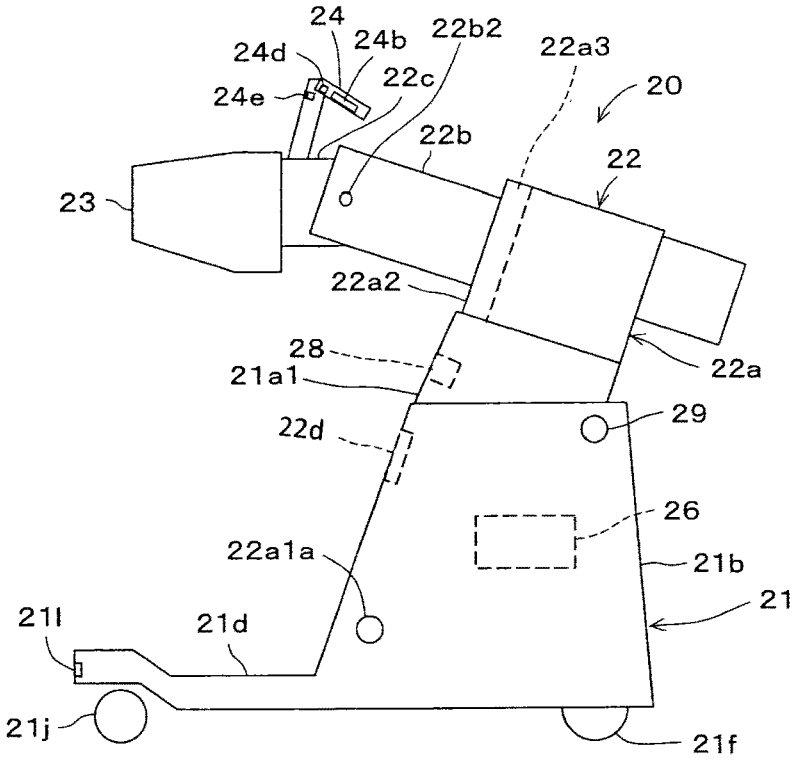
FIG. 2 is a right side view illustrating the care robot illustrated in FIG. 1.
Figure 3:
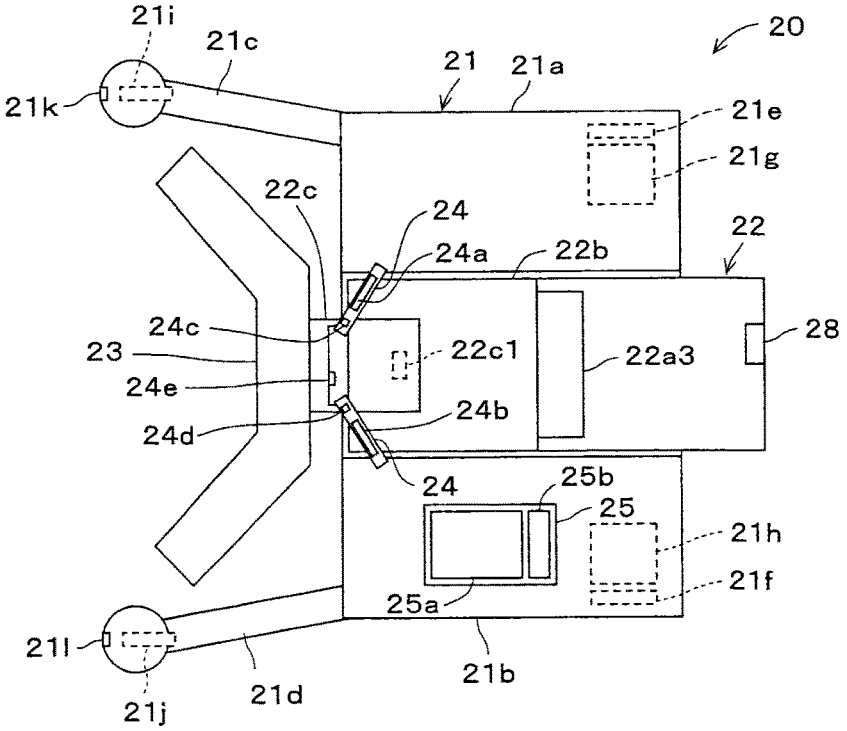
FIG. 3 is a plan view illustrating the care robot illustrated in FIG. 1.

The care robot 20 is a care robot for assisting a standing-upright motion and a sitting motion of the care receiver M1 by supporting a part of the body (for example, the upper half of the body, particularly, the chest) of the care receiver M1. As illustrated in FIGS. 2 and 3, the care robot 20 is configured to include a base 21, a robot arm section 22, a holding section 23, a handle 24, an operation device 25, and a control device 26.

The base 21 includes left and right base portions 21*a* and 21*b* and left and right leg portions 21*c* and 21*d*. The left and right base portions 21*a* and 21*b* are arranged with a predetermined distance therebetween in a lateral direction. Left and right drive wheels 21*e* and 21*f* are respectively disposed in the left and right base portions 21*a* and 21*b*, in which left and right drive wheel motors 21*g* and 21*h* (drive sources) for respectively driving the left and right drive wheels 21*e* and 21*f* are incorporated. The care robot 20 travels using the left and right drive wheels 21*e* and 21*f* which are respectively driven by the left and right drive wheel motors 21*g* and 21*h* (drive sources). The drive sources provided in the base 21 may be omitted, and a user may push and move the care robot 20.

The left and right leg portions 21*c* and 21*d* are disposed to extend horizontally in a forward direction (leftward direction in FIGS. 2 and 3) from the left and right base portions 21*a* and 21*b*. Left and right driven wheels 21*i* and 21*j* are respectively disposed in distal end portions of the left and right leg portions 21*c* and 21*d*. In addition, a pair of collision prevention sensors 21*k* and 21*l* are respectively disposed in distal ends of the left and right leg portions 21*c* and 21*d*. The collision prevention sensors 21*k* and 21*l* are sensors for detecting an obstacle, and a detection signal thereof is transmitted to the control device 26.

The robot arm section 22 is configured so that a base portion thereof is attached to the base 21. As mainly illustrated in FIGS. 4*a* and 5*a*, the robot arm section 22 includes multiple arms 22*a*, 22*b*, and 22*c* which are mutually and relatively movable by using a drive section configured to include first and second rotation-purpose motors 22*a*1*c* and 22*b*3 and a slide-purpose motor 22*a*2*b*. The robot arm section 22 may be configured to include multiple shafts. In this case, the shaft may include at least any one of a rotary shaft and a slide shaft.

As illustrated in FIGS. 4*a*, 4*b*, and 5*a* to 5*c*, a base portion of the first arm 22*a* is attached to the base 21. The first arm 22*a* includes a slide base portion 22*a*1, a first slide portion 22*a*2, and a second slide portion 22*a*3.

As illustrated in FIGS. 2 and 3, the slide base portion 22*a*1 is formed in a substantially rectangular parallelepiped shape. The slide base portion 22*a*1 includes a frame 22*a*1*b* whose base end portion is attached to the base 21 so as to be rotatable around a first rotary shaft 22*a*1*a*. The frame 22*a*1*b* is formed in a substantially U-shape in cross section, and is configured to include left and right plate-shaped members 22*a*1*b*1 and 22*a*1*b*2 which are formed to be bent, and a rear plate-shaped member 22*a*1*b*3 whose left and right ends are connected to upper portion rear ends of the left and right plate-shaped members 22*a*1*b*1 and 22*a*1*b*2.

The first rotation-purpose motor 22*a*1*c* is disposed in the base 21. A first drive belt 22*a*1*d* is disposed across a pulley of the first rotation-purpose motor 22*a*1*c* and a pulley of the first rotary shaft 22*a*1*a*. If the first rotation-purpose motor 22*a*1*c* is driven, the frame 22*a*1*b*, that is, the slide base portion 22*a*1 is rotated around the first rotary shaft 22*a*1*a* in a forward or rearward direction.

Figure 4B:
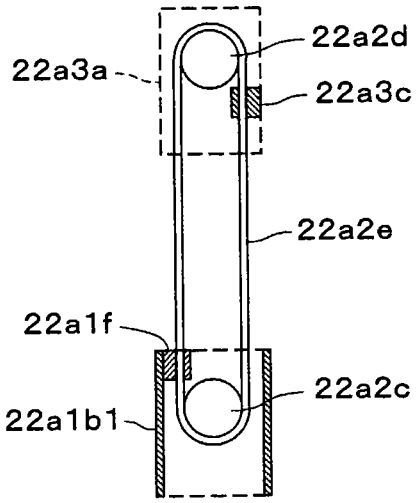
FIG. 4*b* is a front view illustrating the vicinity including a first slide portion illustrated in FIG. 4*a*.
Figure 5A:
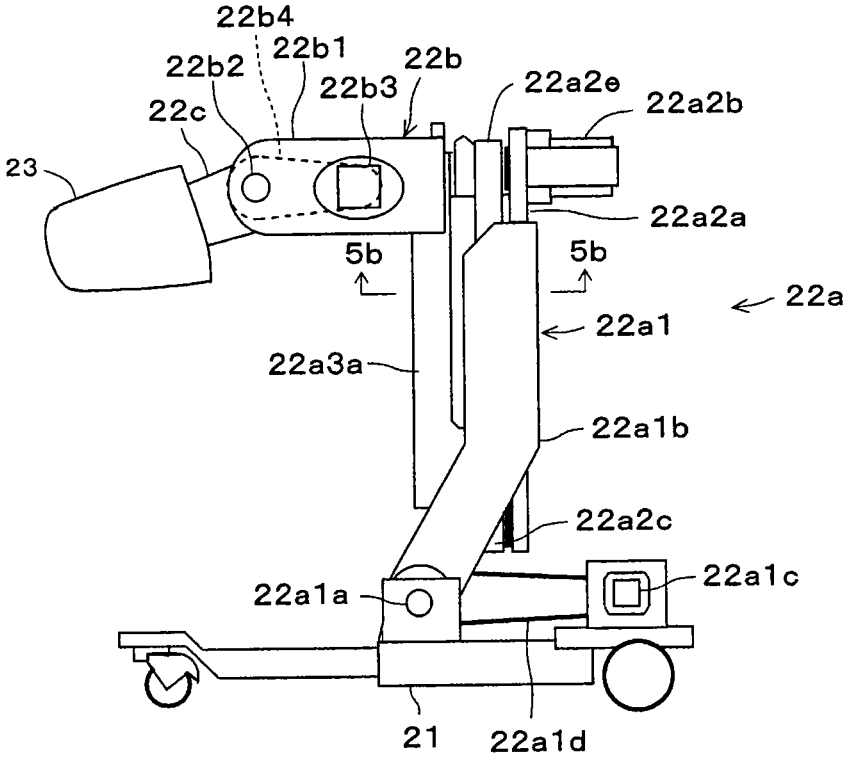
FIG. 5*a* is a right side view illustrating a scheme of the internal structure of the care robot illustrated in FIG. 1 which is in a contracted state.
Figure 5B:
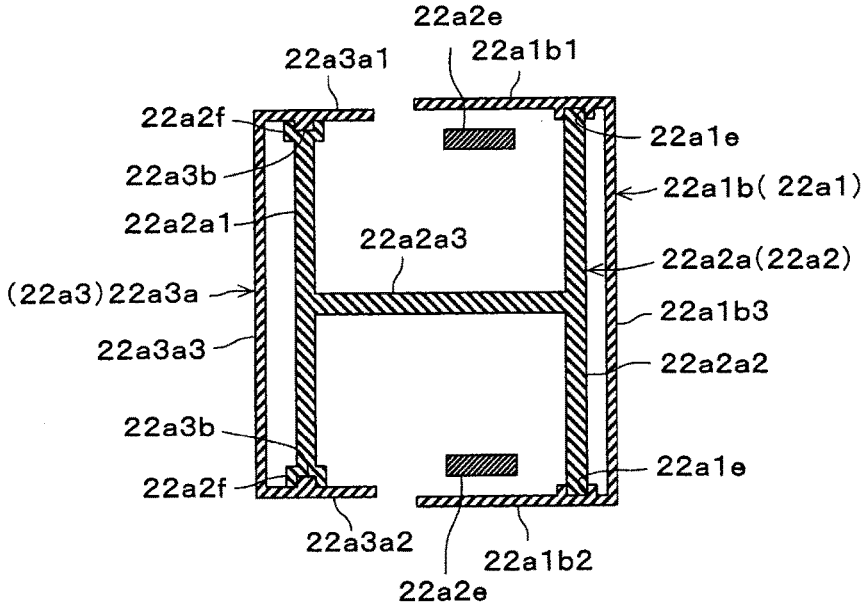
FIG. 5*b* is a cross-sectional view taken along line 5*b*-5*b* illustrated in FIG. 5*a*.

As illustrated in FIG. 5*b*, left and right guide grooves 22*a*1*e* which slidably engage with left and right ends of a rear plate-shaped member 22*a*2*a*2 of a frame 22*a*2*a* of the first slide portion 22*a*2 (to be described later) is formed inside the frame 22*a*1*b* (inside the left and right plate-shaped members 22*a*1*b*1 and 22*a*1*b*2). A stationary portion 22*a*1*f* which is attached and fixed to a sliding belt 22*a*2*e* (to be described later) is disposed in an upper portion of the left plate-shaped member 22*a*1*b*1 of the frame 22*a*1*b* (refer to FIGS. 4*b* and 5*c*).

As illustrated in FIGS. 2 and 3, the first slide portion 22*a*2 is formed in a substantially rectangular parallelepiped shape, and is configured to be smaller than the slide base portion 22*a*1. The first slide portion 22*a*2 slides on the slide base portion 22*a*1 in a longitudinal direction (shaft moving direction), and is configured to be substantially accommodated inside the slide base portion 22*a*1 when being contracted.

Specifically, the first slide portion 22*a*2 includes the frame 22*a*2*a*. As illustrated in FIG. 5*b*, the frame 22*a*2*a* is formed in an H-shape in cross section and an H-shape in a side view, and is configured to include front and rear plate-shaped members 22*a*2*a*1 and 22*a*2*a*2 and a connection plate-shaped member 22*a*2*a*3 whose front and rear ends are connected to vertically central portions of the front and rear plate-shaped members 22*a*2*a*1 and 22*a*2*a*2. Left and right ends of the rear plate-shaped member 22*a*2*a*2 slidably engage with the left and right guide grooves 22*a*1*e* of the frame 22*a*1*b*. As mainly illustrated in FIG. 4*a*, the slide-purpose motor 22*a*2*b* is disposed in an upper portion of the rear plate-shaped member 22*a*2*a*2. A pulley 22*a*2*c* is rotatably disposed in a lower portion of the rear plate-shaped member 22*a*2*a*2. The sliding belt 22*a*2*e* is disposed across a pulley 22*a*2*d* of the slide-purpose motor 22*a*2*b* and the pulley 22*a*2*c*.

Guide rails 22*a*2*f* are disposed in left and right end portions of the front plate-shaped member 22*a*2*a*1 of the frame 22*a*2*a*. The guide rails 22*a*2*f* slidably engage with left and right guide receiving portions 22*a*3*b* inside the left and right plate-shaped members of the frame 22a3a of the second slide portion 22a3 (to be described later).

As illustrated in FIGS. 2 and 3, the second slide portion 22a3 is formed in a substantially rectangular parallelepiped shape, and is configured to be smaller than the first slide portion 22a2. The second slide portion 22a3 slides on the first slide portion 22a2 in the longitudinal direction (shaft moving direction), and is configured to be substantially accommodated inside the first slide portion 22a2 when being contracted.

Specifically, the second slide portion 22a3 includes the frame 22a3a. As illustrated in FIG. 5b, the frame 22a3a is formed in a substantially U-shape in cross section, and is configured to include left and right plate-shaped members 22a3a1 and 22a3a2, and a front plate-shaped member 22a3a3 whose left and right ends are connected to front end portions of the left and right plate-shaped members 22a3a1 and 22a3a2. The left and right guide receiving portions 22a3b which slidably engage with the guide rails 22a2f of the frame 22a2a are disposed inside the frame 22a3a (inner wall surface of the left and right plate-shaped members 22a3a1 and 22a3a2). A stationary portion 22a3c which is attached and fixed to the sliding belt 22a2e is disposed in a lower portion of the right plate-shaped member 22a3a2 of the frame 22a3a (refer to FIGS. 4b and 5c).

Figure 4A:
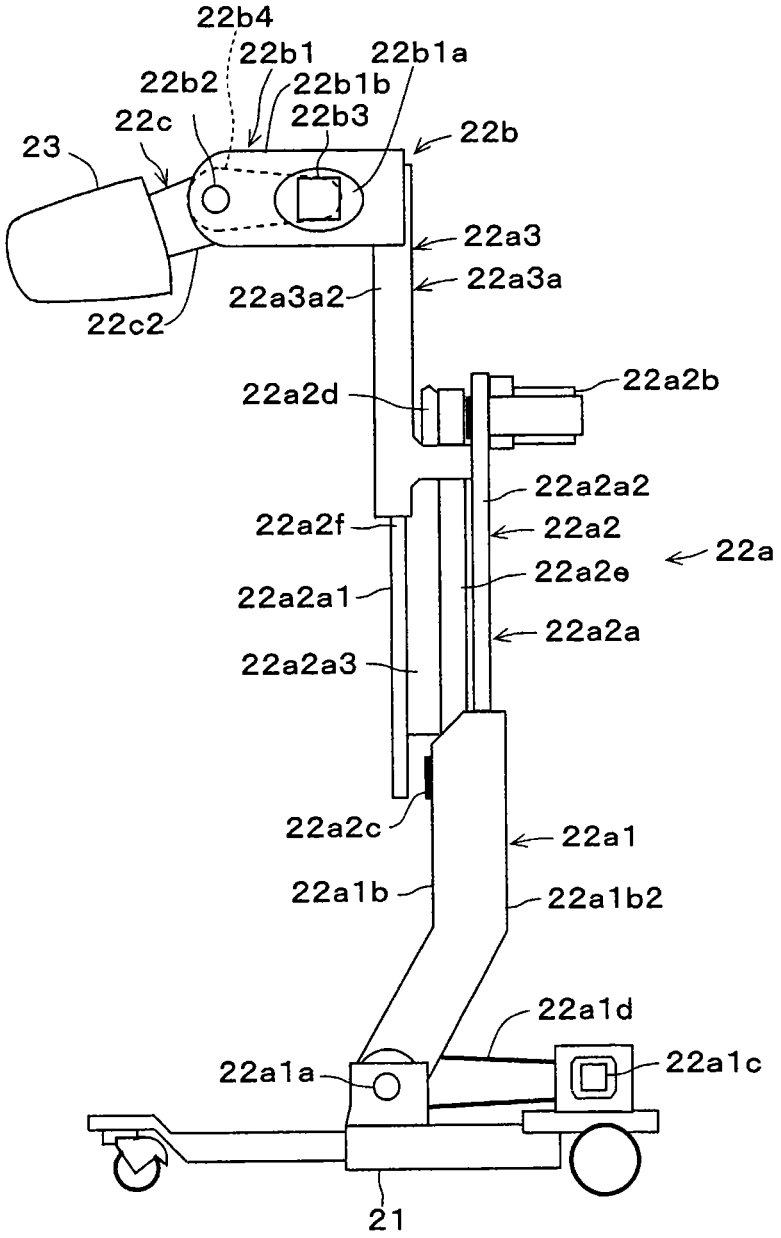
FIG. 4*a* is a right side view illustrating a scheme of an internal structure of the care robot illustrated in FIG. 1 which is in an extended state.

If the slide-purpose motor 22a2b is driven, the frame 22a2a of the first slide portion 22a2 is extended to the frame 22a1b of the slide base portion 22a1 along the shaft moving direction (extended state illustrated in FIGS. 4a and 4b). At the same time, the frame 22a3a of the second slide portion 22a3 is extended to the frame 22a2a of the first slide portion 22a2 (extended state illustrated in FIGS. 4a and 4b).

Figure 5C:
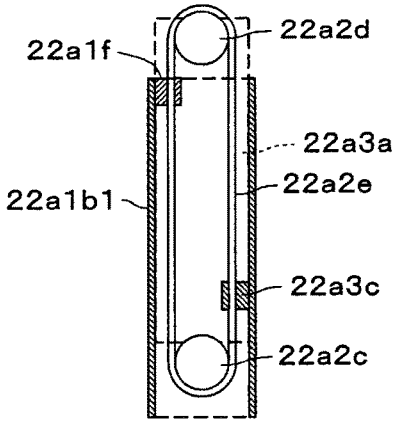
FIG. 5*c* is a front view illustrating the vicinity including the first slide portion illustrated in FIG. 5*a*.

On the other hand, if the slide-purpose motor 22a2b is driven in a reverse direction, the frame 22a2a of the first slide portion 22a2 is contracted to the frame 22a1b of the slide base portion 22a1 in the shaft moving direction (contracted state illustrated in FIGS. 5a and 5c). At the same time, the frame 22a3a of the second slide portion 22a3 is contracted to the frame 22a2a of the first slide portion 22a2 (contracted state illustrated in FIGS. 5a and 5c).

As illustrated in FIGS. 2 and 3, the second arm 22b is formed in a substantially rectangular parallelepiped shape, and is formed in a distal end portion of the second slide portion 22a3 so as to extend in a direction (forward direction) orthogonal to the longitudinal direction. Specifically, as mainly illustrated in FIG. 4a, the second arm 22b includes a frame 22b1 configured to include left and right plate-shaped members 22b1a and 22b1b. Rear end portions of the left and right plate-shaped members 22b1a and 22b1b of the frame 22b1 are respectively connected and fixed to upper end portions of the left and right plate-shaped members 22a3a1 and 22a3a2 of the frame 22a3a.

A second rotary shaft 22b2 is rotatably interposed between distal end portions of the left and right plate-shaped members 22b1a and 22b1b of the frame 22b1. A second rotation-purpose motor 22b3 is disposed in a central portion of the left and right plate-shaped members 22b1a and 22b1b. A second drive belt 22b4 is disposed across a pulley of the second rotation-purpose motor 22b3 and a pulley of the second rotary shaft 22b2.

The third arm 22c is formed in a substantially rectangular parallelepiped shape, and a base end portion thereof is attached to a distal end portion of the second arm 22b so as to be rotatable around the second rotary shaft 22b2. Specifically, the third arm 22c includes a frame 22c2. A rear end portion of the frame 22c2 is fixed so as to be rotated integrally with the second rotary shaft 22b2. A front end portion of the frame 22c2 is fixed to a rear end of the holding section 23. If the second rotation-purpose motor 22b3 is driven, the frame 22c2, that is, the third arm 22c is rotated around the second rotary shaft 22b2 in an upward or downward direction.

The holding section 23 is fixed to a distal end of the third arm 22c. The holding section 23 assists the care receiver M1 in standing upright and sitting by supporting a part of the body (for example, the upper half of the body, particularly, the chest) of the care receiver M1. For example, the holding section 23 is a member which supports both arms (both armpits) of the care receiver M1 from below, when the holding section 23 opposes the care receiver M1 in a standing-upright motion and a sitting motion of the care receiver M1. The holding section 23 is formed in a substantially U-shape in a plan view which is open in the forward direction. For example, the holding section 23 is formed by using a relatively soft material on the assumption that the holding section 23 comes into contact with the care receiver M1.

The handle 24 is fixed to an upper surface of the third arm 22c. The handle 24 is configured to have a pair of left and right rod-shaped handgrips, and to be gripped by left and right hands of the care receiver M1. Contact sensors 24a and 24b for detecting the grip are disposed in the handle 24. A leftward turning switch 24c for turning the care robot 20 to the left and a rightward turning switch 24d for turning the care robot 20 to the right are disposed in the handle 24. Furthermore, a stop switch 24e for stopping the care robot 20 is disposed in the handle 24.

In addition, a load sensor 22c1 for detecting a force receiving from the care receiver M1 when the care receiver M1 walks in a state of being supported by the holding section 23, or the care receiver M1 walks in a state of gripping the handle 24 is disposed in the third arm 22c. The load sensor 22c1 may be a sensor for detecting a distortion amount of a distortion generating element which varies due to a load change, as a voltage change, or a semiconductor-type pressure sensor whose gauge resistance is changed and converted into an electrical signal in response to the distortion when a silicon chip thereof is subject to pressure.

The operation device 25 includes a display section 25a for displaying an image and an operation section 25b for receiving an input operation from a user (caregiver M2 or care receiver M1). The operation device 25 is a selective operation section which selects one form type (to be described later) from multiple form types in accordance with respective multiple movement postures of the care receiver M1.

The display section 25a is configured to have a liquid crystal display, and displays a selection screen for operation modes of the care robot 20. As operation modes, a standing-upright motion assistance mode for assisting a standing-upright motion of a user, and a sitting motion assistance mode for assisting a sitting motion of the user are set therein. The standing-upright assistance mode includes modes which are set to correspond to body parts that a user wants to train. For example, these modes include an upper half part mode for training the upper half of the body, particularly, the back muscles, and a lower half part mode for training the lower half of the body, particularly, the legs.

The operation section 25b includes a cursor key for moving a cursor vertically and laterally, a cancellation key for canceling an input, and a determination key for determining selected content. The operation section 25b is configured so that an instruction of a user can be input by using the keys. The operation device 25 may have a display function of the display section 25*a* and an input function of the operation section 25*b*, and may be configured to have a touch panel for operating the devices by a display on a screen being pressed.

A storage device (memory section) 27 stores standing-upright trajectory reference data indicative of a standing-upright trajectory along which a movement control portion (for example, a shoulder position Ps) of the care receiver M1 moves when the sitting care receiver M1 (refer to FIG. 8) stands upright with the support of the holding section 23, and sitting trajectory reference data indicative of a sitting trajectory which is different from the standing-upright trajectory, and along which the shoulder position Ps of the care receiver M1 moves when the standing care receiver M1 (refer to FIG. 9) sits with the support of the holding section 23.

Figure 10:
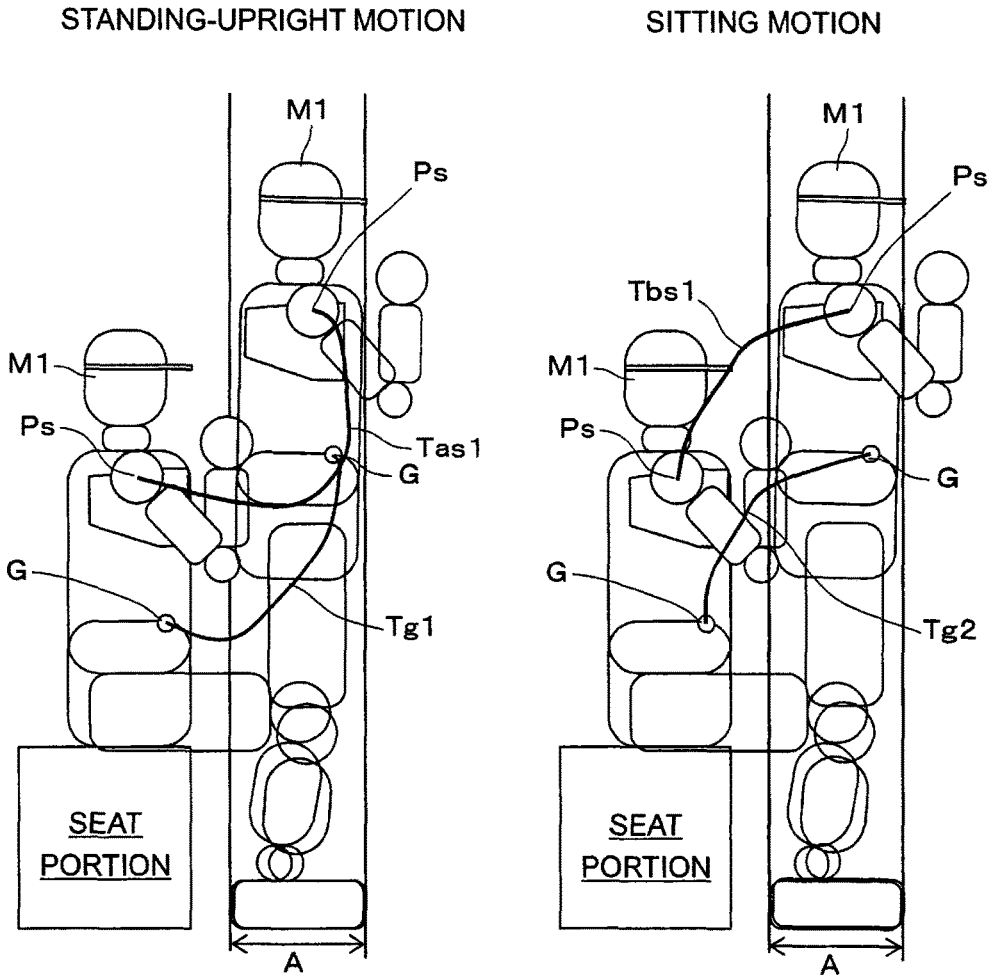
FIG. 10 is a view illustrating a standing-upright motion on the left half side of the view, and a sitting motion on the right half side of the view.

As illustrated in FIG. 10, a standing-upright trajectory Tas1 is set such that a center G of gravity of the care receiver M1 is present in a range A of the soles of both feet of the care receiver M1 between a point in time early after the start of the standing-upright motion and an end time point of the standing-upright motion of the care receiver M1. Tg1 represents the trajectory of the center G of gravity.

As illustrated in FIG. 10, a sitting trajectory Tbs1 is set such that the center G of gravity of the care receiver M1 is present out of the range A of the soles of both feet from a point in time early after the start of the sitting motion of the care receiver M1 which is the motion to allow the care receiver to sit, and moves toward a predetermined sitting position of the care receiver M1. The sitting trajectory Tbs1 is set such that the sitting trajectory Tbs1 is positioned above the standing-upright trajectory Tas1. Tg2 represents the trajectory of the center G of gravity.

Figure 11:
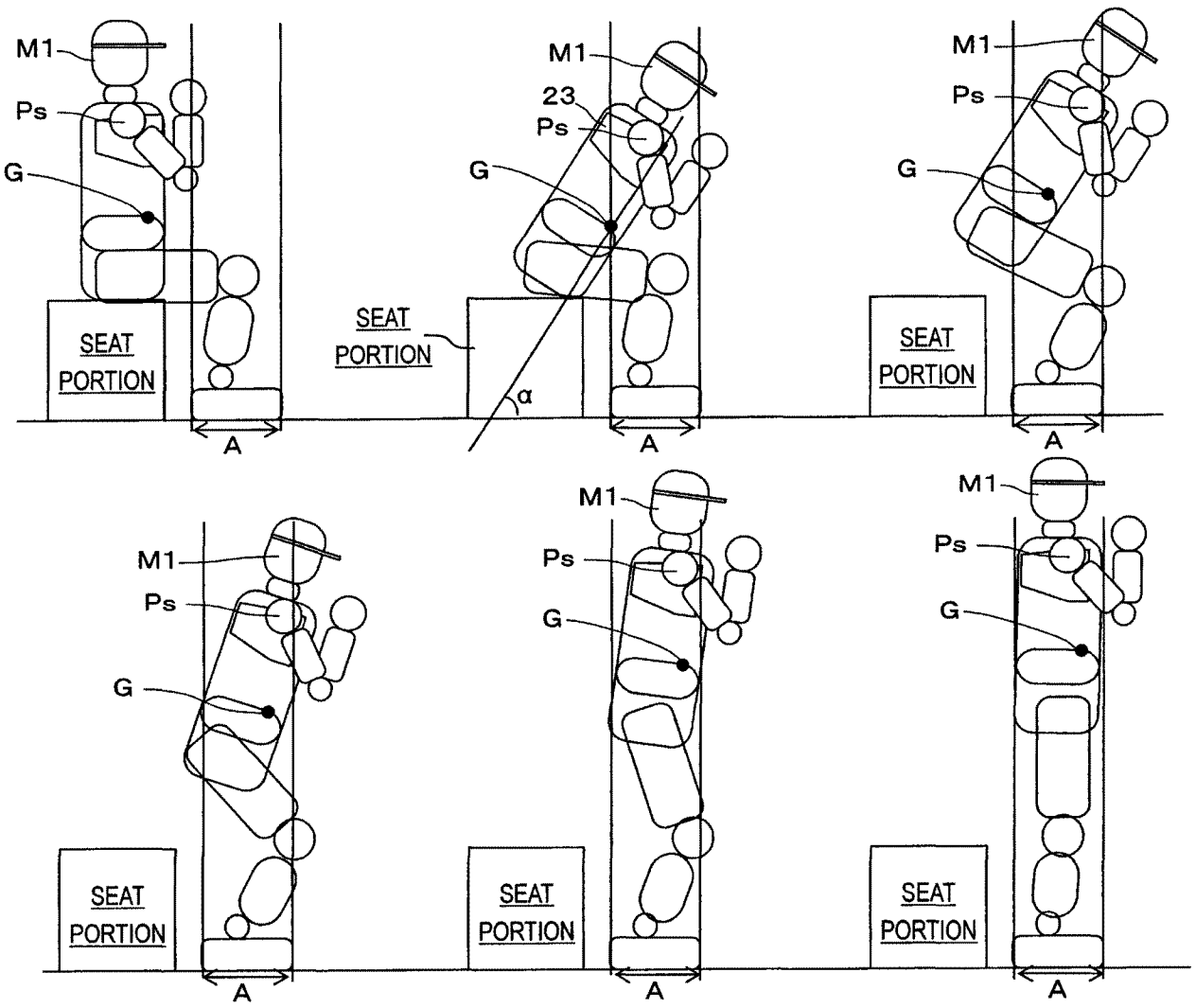
FIG. 11 is a view illustrating the standing-upright motion.

The standing-upright trajectory Tas1 and the sitting trajectory Tbs1 may be prepared by actually capturing images of the standing-upright motion of a healthy person, and using two-dimensional coordinates (for example, x-y coordinates) of the shoulder position Ps. The standing-upright trajectory is illustrated in FIG. 11. The standing-upright motion is sequentially illustrated from a state (sitting state) on the top left side toward a state (standing-upright state) on the bottom right side. A second state (at an upper middle position) represents the point in time early after the start of the standing-upright motion, and represents a time point when the sitting care receiver M1 leans forward, and lifts his or her waist upward. The center G of gravity of the care receiver M1 is present in the range A of the soles of both feet of the care receiver M1 between the second state and the end time point (sixth state) of the standing-upright motion.

Figure 12:
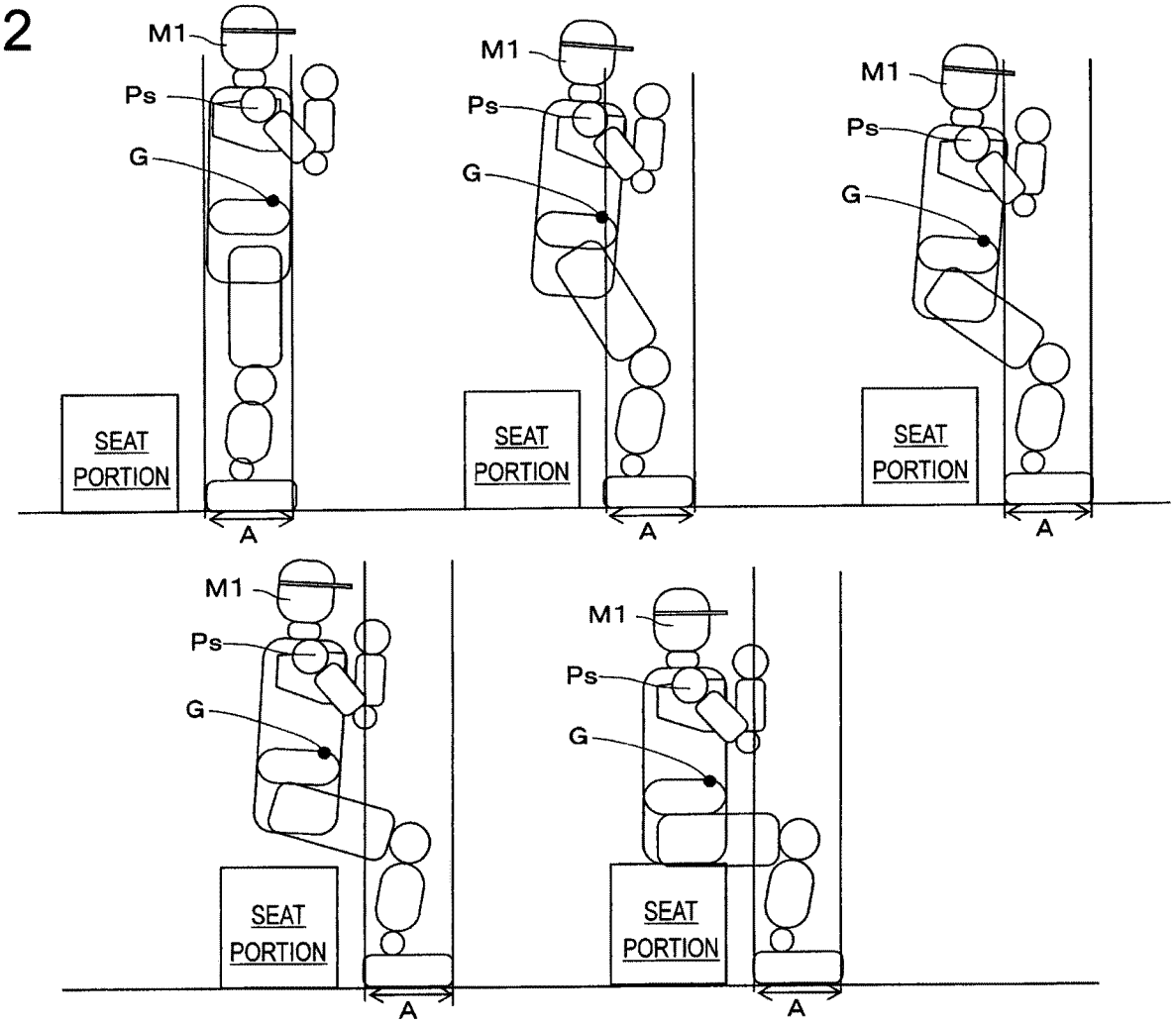
FIG. 12 is a view illustrating the sitting motion.

The sitting trajectory is illustrated in FIG. 12. The sitting motion is sequentially illustrated from a state (standing-upright state) on the top left side toward a state (sitting state) on the bottom right side. A second state (at an upper middle position) represents the point in time early after the start of the sitting motion, and represents a time point when the standing care receiver M1 lowers his or her waist, and the center G of gravity of the care receiver M1 leaves the range A of the soles of both feet of the care receiver M1. The center G of gravity of the care receiver M1 leaves the range A of the soles of both feet of the care receiver M1, and moves toward a predetermined sitting position (positioned on a chair) of the care receiver M1 between the second state and the end time point (fifth state) of the sitting motion. The standing-upright trajectory and the sitting trajectory may be prepared by simulation.

Each item of trajectory reference data is represented by two-dimensional coordinates. For example, the standing-upright trajectory reference data is expressed as n x-y coordinates ((Xa1, Ya1), . . . , (Xan, Yan)). For example, the sitting trajectory reference data is expressed as n x-y coordinates ((Xb1, Yb1), . . . , (Xbn, Ybn)). The origin may be the reference point of the care robot 20, the coordinates of the first rotary shaft 22*a*1*a*, a coordinate in the sitting state, or an arbitrary point on the sitting surface of the care receiver M1.

The trajectory reference data is preferably configured to include an angle α of the holding section 23 for each coordinate in addition to the x-y coordinates. The angle α of the holding section 23 for each coordinate represents an angle of the holding section 23 at each point in the standing-upright trajectory Tas1 and the sitting trajectory Tbs1 (refer to FIG. 11). The angle α is an angle which is formed by the upper half part (inner wall surface of the holding section 23 which comes into contact with the care receiver M1 so as to hold the care receiver M1) of the body of the care receiver M1 and a horizontal plane. For example, as illustrated in FIG. 11, when the care receiver M1 is in a sitting position or in a standing-upright position, the angle α is 90 degrees. For example, the trajectory reference data is expressed as (Xa1, Ya1, α1), . . . , (Xan, Yan, αn).

The trajectory reference data may not be represented by two-dimensional coordinates, but may be represented by robot coordinates. For example, as illustrated in FIG. 13, the standing-upright trajectory reference data is configured to include a first angle (θa) which is the rotation angle of the first rotation-purpose motor 22*a*1*c*, an arm length (L: slide amount: rotation angle corresponding to the arm length) of the slide-purpose motor 22*a*2*b*, and a second angle (θb) which is the rotation angle of the second rotation-purpose motor 22*b*3. The coordinate (Xa1, Ya1, α1), obtained by adding the angle α to the x-y coordinates, is expressed as a robot coordinate (θa1, L1, θb1).

Figure 14:
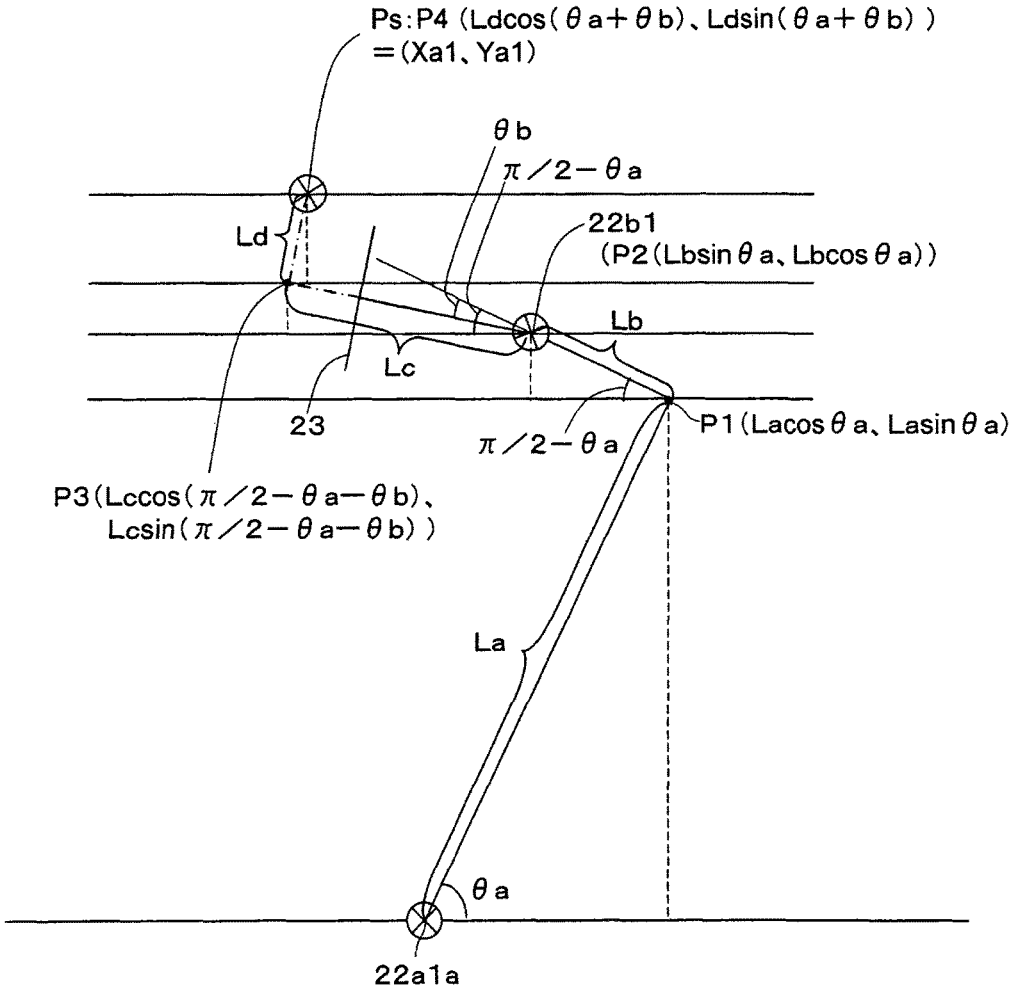
FIG. 14 is a schematic side view illustrating the length and the angle of a robot anti section.

Hereinafter, a method of calculating a robot coordinate (θa1, L1, θb1) from the coordinate (Xa1, Ya1, α1) obtained by adding the angle α to the x-y coordinates will be briefly described. FIG. 14 is a schematic side view illustrating the length and the angle of the robot arm section 22. As illustrated in FIG. 14, La (variable value) represents the length of the first arm 22*a*, Lb (fixed value) represents the length of the second arm 22*b*, and Lc (fixed value) and Ld (fixed value) represent lengths from a second rotary shaft 22*b*1 to the shoulder position Ps along an extension direction of the third arm 22*c* and along a direction perpendicular to the extension direction, respectively. The first angle θa represents an angle formed by the first arm 22*a* and a horizontal line, an angle formed by the first arm 22*a* and the second arm 22*b* is 90 degrees, and the second angle θb represents an angle formed by the second arm 22*b* and the third arm 22*c*.

The X-Y coordinates of a point P1, at which the first arm 22*a* intersects the second arm 22*b*, is (La×(cos θa), La×(sin θa)). The X-Y coordinates of a point P2 indicative of the second rotary shaft 22*b*1 is obtained by adding (Lb×(sin θa), Lb×(cos θa)) to the X-Y coordinates of the point P1. The X-Y coordinates of a point P3 at which a perpendicular line extending from the shoulder point Ps intersects the third arm 22*c*, is obtained by adding (Lc×(cos(π/2−θa−θb), Lc×(sin (π/2−θa−θb)) to the X-Y coordinates of the point P2. The X-Y coordinates of the shoulder position Ps, that is, a point P4 is obtained by adding (Ld×(cos(θa+θb), Ld×(sin(θa+θb)) to the X-Y coordinates of the point P3. The angle α of the holding section 23 for each coordinate is expressed as π−(π/2+(π/2−θa−θb), that is, α=θa+θb. In this manner, the robot coordinate (θa1, L1, bb1) is calculated from the coordinate (Xa1, Ya1, α1) obtained by adding the angle α to the X-Y coordinates.

As illustrated in FIG. 13, the robot coordinate may be configured to include a first angular velocity ($\overline{\omega}$a) which is the angular velocity of the first angle (θa), that is, the rotation angle of the first rotation-purpose motor 22*a*1*c*, the slide velocity (V: rotation angular velocity corresponding to the slide velocity) of the slide-purpose motor 22*a*2*b*, and a second angular velocity ($\overline{\omega}$b) which is the angular velocity of the second angle (θb), that is, the rotation angle of the second rotation-purpose motor 22*b*3.

In this case, by appropriately setting these velocities, it is possible to set the velocity of the holding section 23 when the sitting care receiver M1 stands upright with the support of the holding section 23 to be different from the velocity of the holding section 23 when the standing care receiver M1 sits with the support of the holding section 23.

Figure 15:
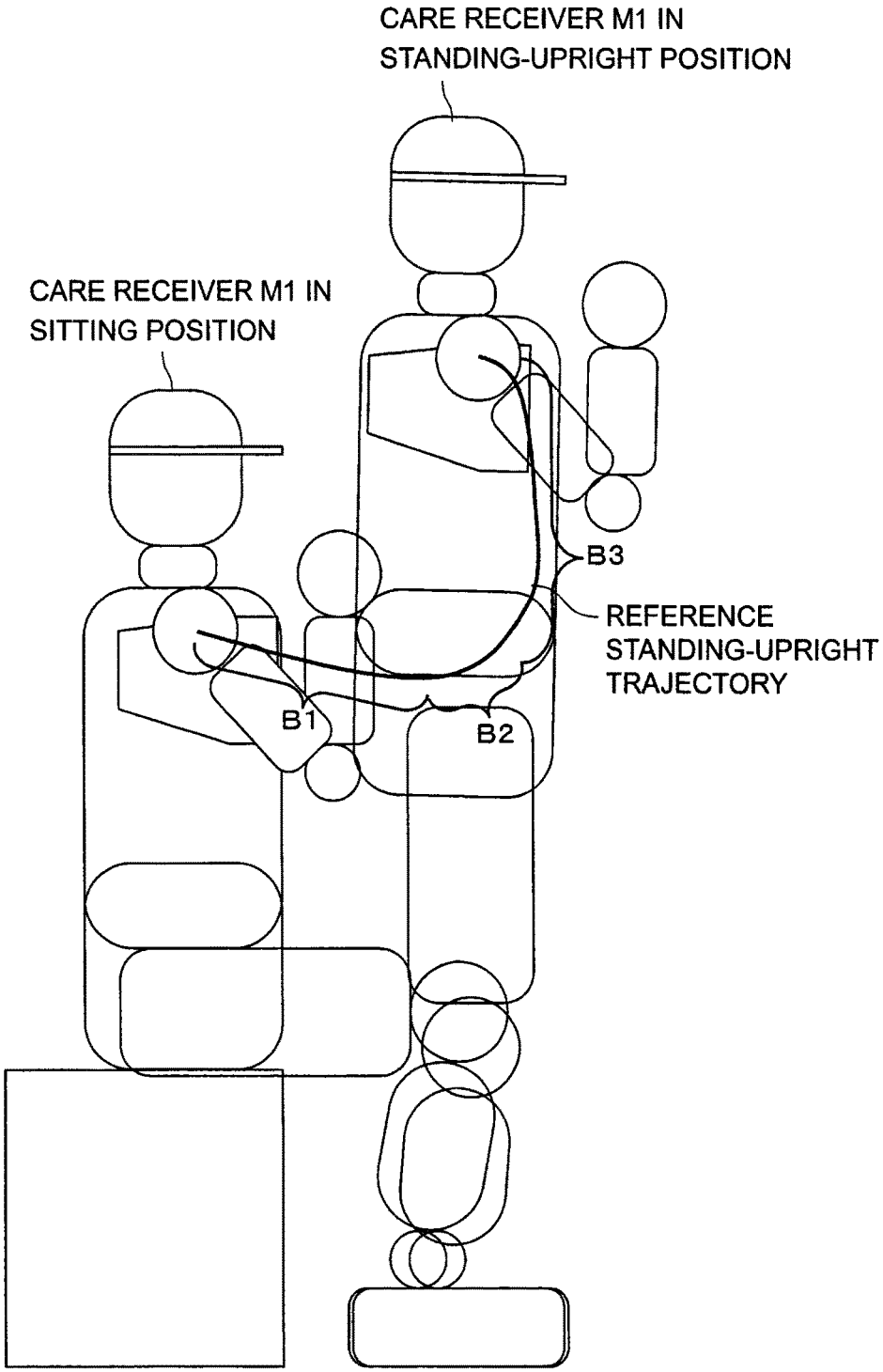
FIG. 15 is a view illustrating zones, which correspond to body parts that the care receiver wants to train, among multiple zones in the standing-upright trajectory (for example, a reference standing-upright trajectory).

As illustrated in FIG. 15, when the sitting care receiver M1 stands upright with the support of the holding section 23, by appropriately setting these velocities, it is possible to set the velocity of the holding section 23 to a velocity corresponding to a burden on the care receiver M1 in a zone, corresponding to a body part that the care receiver M1 wants to train, among multiple zones in the standing-upright trajectory (for example, the reference sitting trajectory). In a first zone B1 and a third zone B3, a burden on the upper half of the body, particularly, the back muscles increases, and in a second zone B2, a burden on the lower half of the body, particularly, the femoral muscles increases. The reason for this is that the care receiver M1 leans forward in the first zone B1, starts to rise in the second zone B2, and has risen to some extent and then uses the upper half of the body in the third zone B3. If the care receiver M1 slowly moves through each zone, a burden on the care receiver M1 increases compared to when the care receiver M1 quickly moves through each zone because the care receiver M1 is required to maintain the corresponding posture in each zone for a long period of time.

Figure 16:
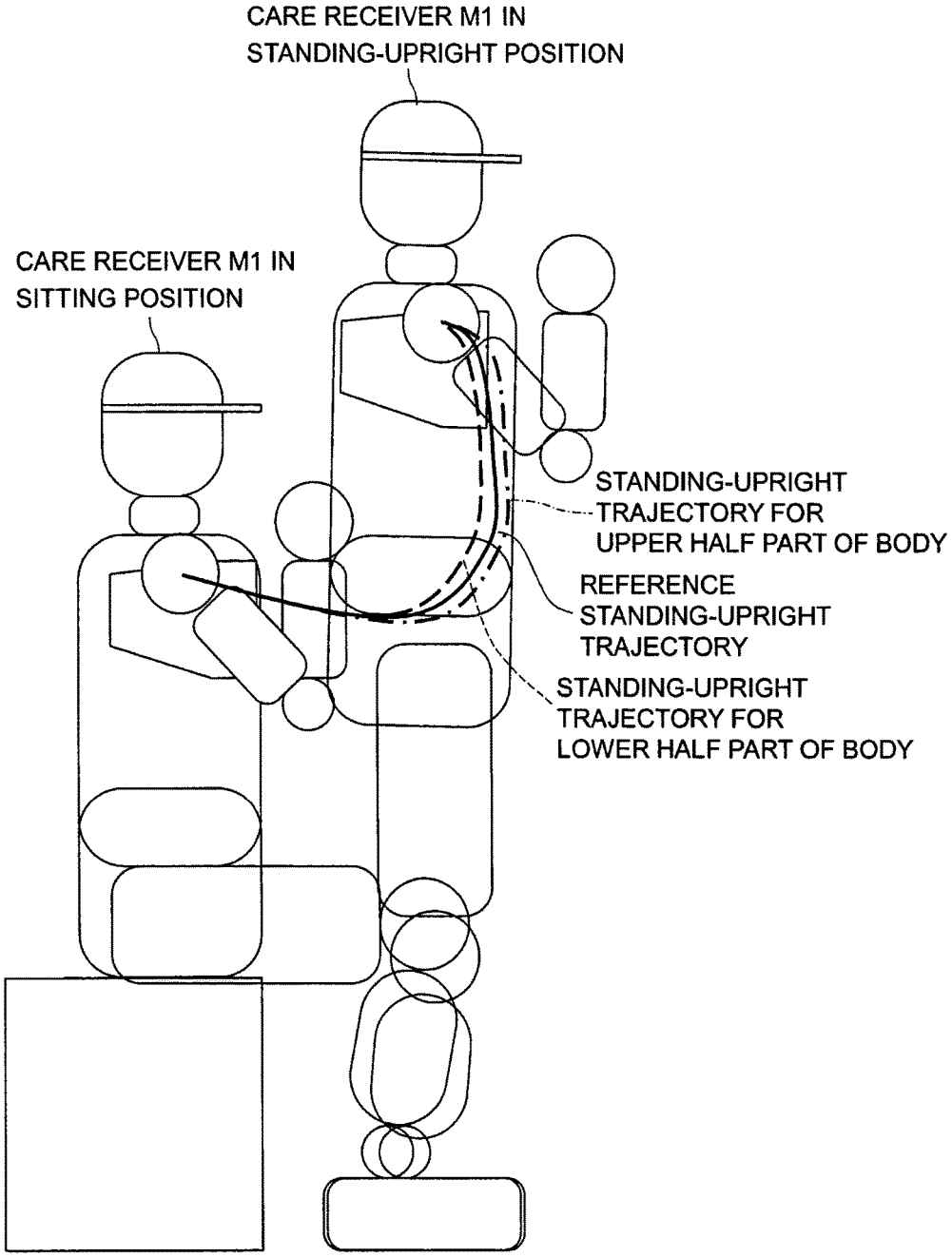
FIG. 16 is a view illustrating the reference standing-upright trajectory corresponding to standing-upright trajectory reference data, a standing-upright trajectory for training the upper half of the body corresponding to standing-upright trajectory data for the upper half of the body, and a standing-upright trajectory for training the lower half of the body corresponding to standing-upright trajectory data for the lower half of the body.

The storage device 27 further stores multiple items of standing-upright trajectory data other than the standing-upright reference data. The multiple items of the standing-upright trajectory data indicate trajectories which are different from the standing-upright trajectory (the reference standing-upright trajectory) corresponding to the standing-upright trajectory reference data, and are prepared to train multiple different body parts of the care receiver M1. FIG. 16 illustrates the trajectories corresponding to the standing-upright trajectory data items. The solid line represents the reference standing-upright trajectory corresponding to the standing-upright trajectory reference data, the alternating long and short dash line represents a standing-upright trajectory for the upper half of the body for training the upper half of the body, particularly, the back muscles, which corresponds to standing-upright trajectory data for the upper half of the body, and the dashed line represents a standing-upright trajectory for the lower half of the body for training the lower part of the body, particularly, the legs, which corresponds to standing-upright trajectory data for the lower half of the body.

When the care receiver M1 is assisted in standing upright along the standing-upright trajectory for the upper half of the body, the care receiver M1 leans forward more than when being assisted along the reference standing-upright trajectory, and thus the care receiver M1 uses the back muscles more than the legs (burden on the back muscles increases). Accordingly, it is possible to increase a burden on the upper half of the body, particularly, the back muscles. When the care receiver M1 is assisted in standing upright along the standing-upright trajectory for the lower half of the body, the care receiver M1 leans forward less than when being assisted along the reference standing-upright trajectory, and thus the care receiver M1 uses the leg muscles more than the back muscles (burden on the leg muscles increases). Accordingly, it is possible to increase a burden on the lower half of the body, particularly, the legs.

Furthermore, the storage device 27 stores a correction amount (first correction amount) according to the height of a seat portion such as a chair or a bed on which the care receiver M1 sits. The first correction amount is a value for correcting the above-described respective data items. The above-described respective data items are data items when the height of the seat portion has a predetermined value (for example, 40 cm).

For example, when the height of the seat portion is +Δh1, the first correction amount is −Δφa1 with regard to the first angle θa, the first correction amount is +ΔLb1 with regard to the arm length L, and the first correction amount is +Δφb1 with respect to the second angle θb. When the height is −Δh1, the first correction amount is +Δφa1 with regard to the first angle θa, the first correction amount is −ΔLb1 with regard to the arm length L, and the first correction amount is +Δφb1 with respect to the second angle θb. The first correction amount is stored each time a difference from the predetermined value is a predetermined amount. These correction amounts are set in advance based on data obtained through experiments using an actual device so as to have a suitable form according to the height of the seat portion.

In addition, the storage device 27 stores a correction amount (second correction amount) according to the height of the care receiver M1. The second correction amount is a value for correcting the above-described respective data items. The above-described respective data items are data items when the height of the care receiver M1 has a predetermined value (for example, average height; specifically, 170 cm).

For example, when the height is +ΔH1, the second correction amount is −Δφa1 with regard to the first angle θa, the second correction amount is +ΔLb1 with regard to the arm length L, and the second correction amount is +Aφb1 with regard to the second angle θb. In addition, when the height is −ΔH1, the second correction amount is +Δφa1 with regard to the first angle θa, the second correction amount is −ΔLb1 with regard to the arm length L, and the second correction amount is +Δφb1 with regard to the second angle θb. The second correction amount is stored each time a difference from the predetermined value is a predetermined amount. These correction amounts are set in advance based on data obtained through experiments using an actual device so as to have a suitable form according to the heights in each form type. The above-described respective correction amounts are stored as a mapping. However, the correction amounts may be stored as calculation expressions.

Figure 6:
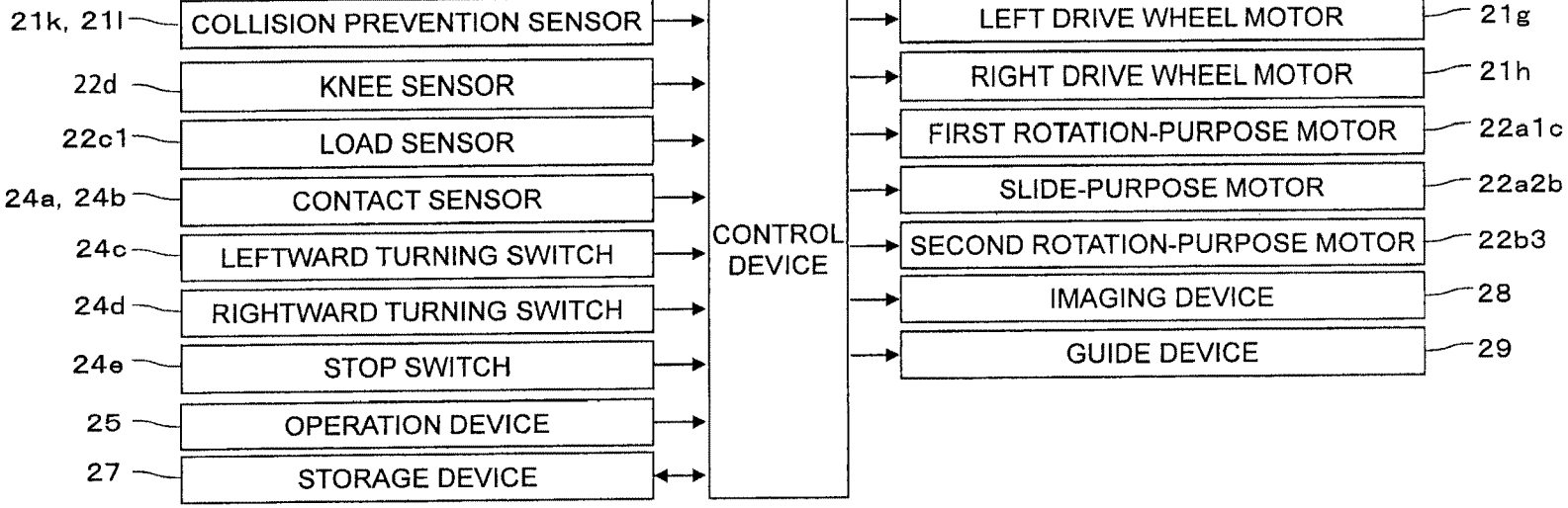
FIG. 6 is a block diagram illustrating the care robot illustrated in FIG. 1.

The control device 26 performs control related to traveling or posture transformation of the care robot 20. As illustrated in FIG. 6, the above-described collision prevention sensors 21*k* and 21*l*, a knee sensor 22*d*, the load sensor 22*c*1, the contact sensors 24*a* and 24*b*, the leftward turning switch 24*c*, the rightward turning switch 24*d*, the stop switch 24*e*, the left and right drive wheel motors 21*g* and 21*h*, the first rotation-purpose motor 22*a*1*c*, the slide-purpose motor 22*a*2*b*, the second rotation-purpose motor 22*b*3, the operation device 25, the storage device 27, the imaging device 28, and the guide device 29 are connected to the control device 26. In addition, the control device 26, has a microcomputer (not illustrated). The microcomputer includes an I/O interface, a CPU, a RAM, and a ROM (all are not illustrated) which are connected to one another via a bus.

Figure 7:
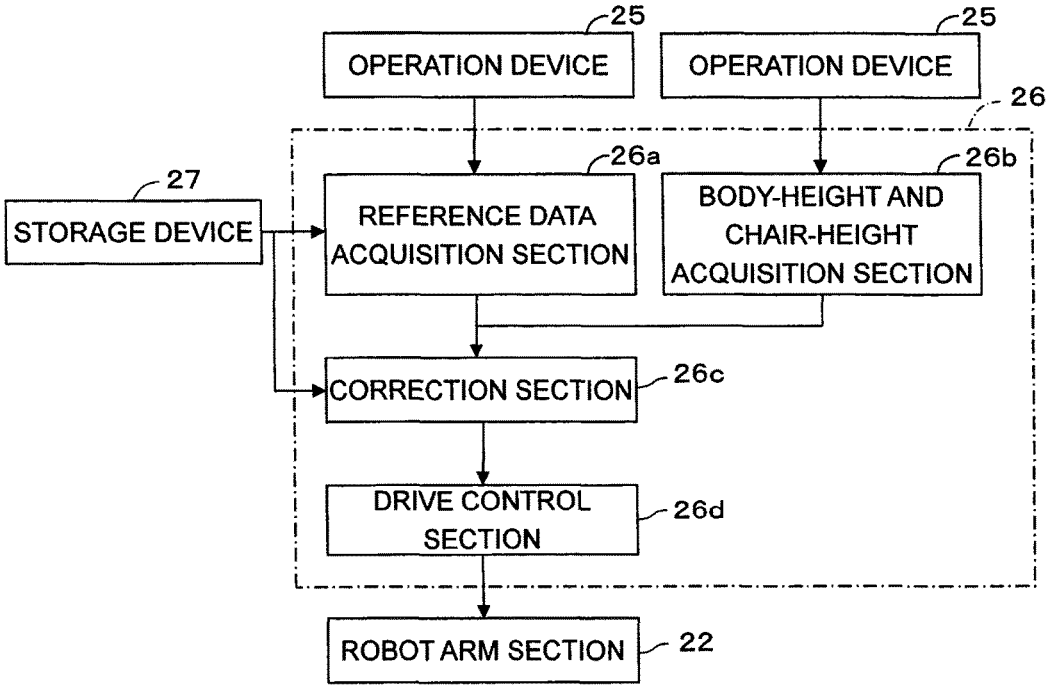
FIG. 7 is a block diagram illustrating a control device illustrated in FIG. 6.

As illustrated in FIG. 7, the control device 26 includes a reference data acquisition section 26*a*, a body-height and chair-height acquisition section 26*b*, a correction section 26*c*, and a drive control section 26*d*. The reference data acquisition section 26*a* acquires the standing-upright motion assistance mode (any one of a normal mode, an upper half part mode, and a lower half part mode) selected by the operation device 25, and acquires data, corresponding to the acquired mode, from the storage device 27. The reference data acquisition section 26*a* acquires the standing-upright trajectory data for the upper half of the body in the upper half part mode, the standing-upright trajectory data for the lower half of the body in the lower half part mode, and the standing-upright trajectory reference data in the normal mode that is neither the upper half part mode nor the lower half part mode. The reference data acquisition section 26*a* also acquires the sitting motion assistance mode selected by the operation device 25.

The body-height and chair-height acquisition section 26*b* acquires the height of the care receiver M1 selected by the operation device 25, or the height of the seat portion such as a chair or a bed on which the care receiver M1 sits. The correction section 26*c* corrects the data acquired by the reference data acquisition section 26*a* in correspondence with the body height and the height of the seat portion acquired by the body-height and chair-height acquisition section 26*b*. Specifically, the correction section 26*c* acquires the second correction amount corresponding to the acquired body height, or the first correction amount corresponding to the height of the seat portion from the storage device 27. The correction section 26*c* corrects the data items acquired by the reference data acquisition section 26*a* in correspondence with the acquired correction amounts.

The drive control section 26*d* drives a drive section configured to include the first rotation-purpose motor 22*a*1*c*, the second rotation-purpose motor 22*b*3, and the slide-purpose motor 22*a*2*b*, and thus the robot arm section 22 is driven to perform a standing-upright operation based on the standing-upright trajectory reference data (or the standing-upright trajectory data for the upper half of the body, or the standing-upright trajectory data for the lower half of the body). In addition, the drive control section 26*d* drives the drive section such that the robot arm section 22 is driven to perform a sitting operation based on the sitting trajectory reference data. Specifically, the drive control section 26*d* reads the data, acquired by the reference data acquisition section 26*a*, from the storage device 27. Then, the drive control section 26*d* drives the drive section in correspondence with the read data.

When the respective data items are stored while also including the angle $\alpha$ of the holding section 23 at each point in the standing-upright trajectory and the sitting trajectory, the control device 26 (the drive control section 26*d*) drives the drive section such that the angle of the holding section at each point is controlled to become the angle stored in the standing-upright trajectory reference data and the sitting trajectory reference data. When the sitting care receiver M1 stands upright with the support of the holding section 23, the control device 26 (the drive control section 26*d*) drives the robot arm section 22 based on the data acquired by the reference data acquisition section 26*a*, which corresponds to body parts that the care receiver M1 wants to train. The control device 26 (the drive control section 26*d*) performs control such that the velocity of the holding section 23 when the sitting care receiver M1 stands upright with the support of the holding section 23 becomes different from the velocity of the holding section 23 when the standing care receiver M1 sits with the support of the holding section 23. When the sitting care receiver M1 stands upright with the support of the holding section 23, the control device 26 (the drive control section 26*d*) controls the velocity of the drive section such that the velocity of the holding section 23 becomes a velocity corresponding to a burden on the care receiver M1 in a zone, corresponding to a body part that the care receiver M1 wants to train, among the multiple zones in the standing-upright trajectory. The control device 26 (the drive control section 26*d*) adjusts the standing-upright trajectory and the sitting trajectory of the robot arm section 22 in correspondence with the body height of the care receiver M1 or the height of the seat portion.

Next, an operation of the care robot 20 configured as described above will be described. First, a movement of the care robot 20 will be described. A case will be described in which the care robot 20 moves alone from the station 11 to the respective private rooms 13*a* to 13*d* (or from the respective private rooms 13*a* to 13*d* to the station 11). When moving through the corridor 14 from the station 11 to the respective private rooms 13*a* to 13*d*, the care robot 20 moves along a route stored in the storage device 27, which is a route from the entrance/exit 11*a* of the station 11 to the respective entrances/exits 13*a*1 to 13*d*1 of the respective private rooms 13*a* and 13*d*.

In addition, the care robot 20 reads guiding marks 14*a* disposed in the corridor 14 via the imaging device 28, calculates the remaining traveling distance from the information, and moves based on the calculation result. For example, the guiding marks 14*a* may be two-dimensional bar codes. The two-dimensional bar codes store information items such as a current location (for example, intersection of the corridors 14), and a distance and a direction from the current location to a destination (for example, distance and direction (leftward turning) from the intersection to the first private room 13*a* when the care robot 20 approaches the intersection of the corridors 14 in a case where the care robot 20 moves from the station 11 to the first private room 13*a*). The guiding marks 14*a* are disposed at corners of the entrance/exit 11*a* of the station 11, the respective entrances/exits 13*a*1 to 13*d*1 of the respective private rooms 13*a* to 13*d*, and predetermined locations of the corridors 14 (for example, a corner at the intersection or a ceiling surface).

Next, a case will be described in which the care robot 20 comes close to the sitting care receiver M1. In this case, the care robot 20 enters the first private room 13*a* through the entrance/exit 13*a*1 of the first private room 13*a*, and then, comes close to the care receiver M1 who sits on an edge of a bed. The care robot 20 moves forward while the front surface of the care robot 20 is oriented in the traveling direction. The care robot 20 reads the guiding marks 14*b* disposed in the vicinity of the care receiver M1 via the imaging device 28 disposed on the front surface, and comes close to the care receiver M1 based on the information.

Furthermore, a standing-upright operation and a seating operation of the care robot 20 will be described with reference to FIGS. 8 to 10. The care robot 20 uses a detection result (distance between the care robot 20 and the knee of the care receiver M1) of the knee sensor 22*d*, and moves to a predetermined position where a distance from the sitting care receiver M1 becomes a predetermined distance. The predetermined position is the optimum position for allowing the care receiver M1 to stand upright (standing-upright optimum position).

Then, the care robot 20 guides the care receiver M1, "Please grip the handle". If the care receiver M1 grips the handle 24 with both hands, the contact sensors 24*a* and 24*b* detect that the handle 24 is gripped. Accordingly, the care robot 20 performs a standing-upright operation for allowing the care receiver M1 to stand upright.

Figure 8:
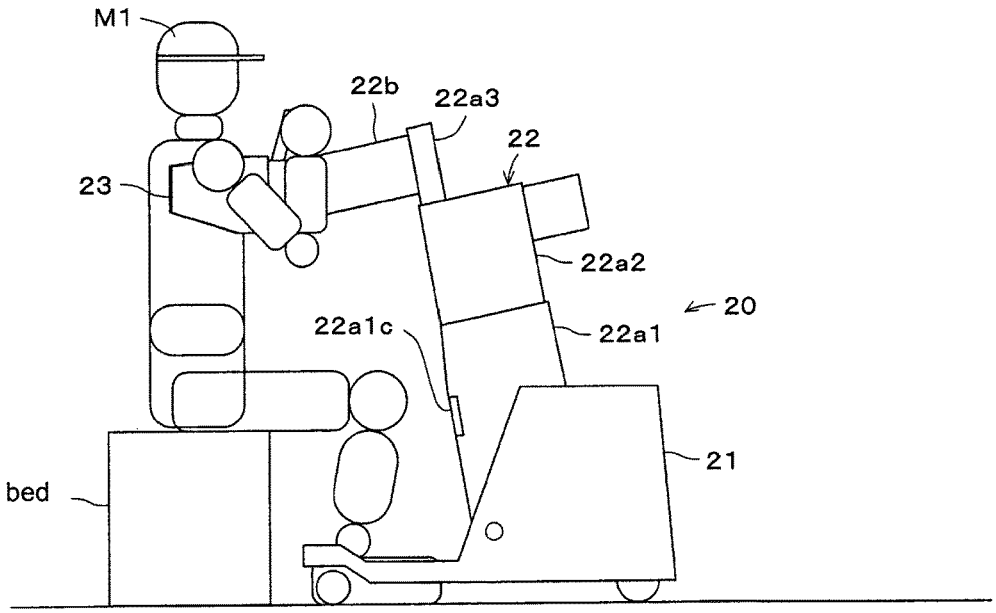
FIG. 8 is a side view illustrating a state in which the care robot supports a sitting care receiver.
Figure 9:
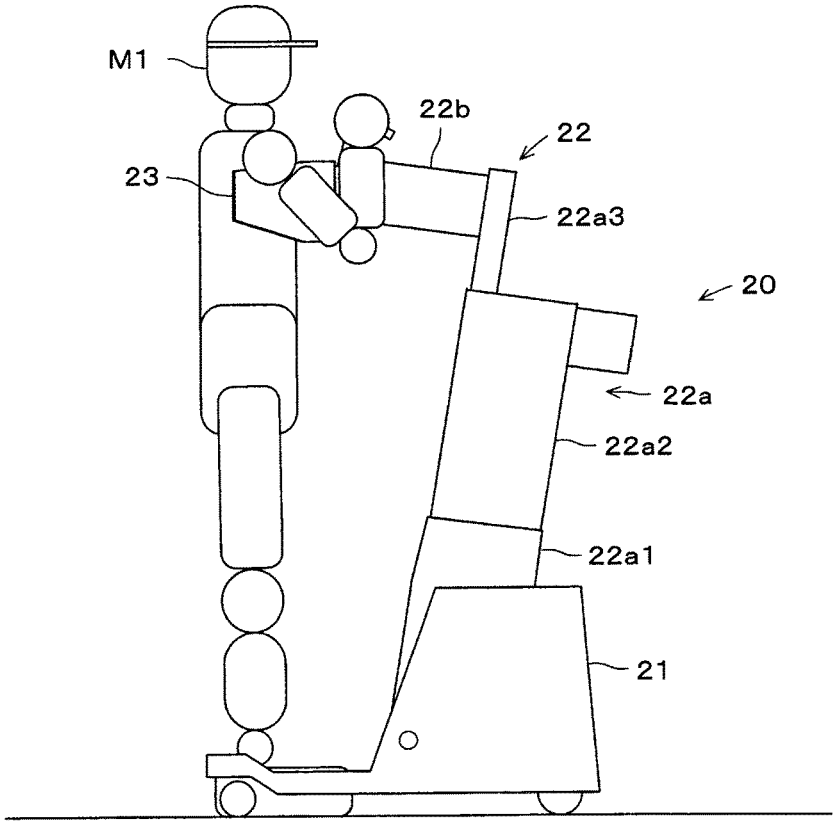
FIG. 9 is a side view illustrating a state where the care robot supports the care receiver standing upright.

If the standing-upright operation starts, the care robot 20 causes the holding section 23 to hold the upper body of the sitting care receiver M1 (refer to FIG. 8). Then, while holding the upper body, the care robot 20 brings the care receiver M1 into a standing-upright state (refer to FIG. 9). More specifically, as illustrated in FIG. 10, the standing-upright motion is performed along the reference standing-upright trajectory.

The care robot 20 assists the care receiver M1 in the standing-upright state. The care receiver M1 walks and moves while holding the holding section 23 under his or her arms. In a case where the care robot 20 assisting the walking of the care receiver M1 in this way moves from the first private room 13*a* to the training room 12, similarly to the above-described case where the care robot 20 moves alone, the care robot 20 moves along a route stored in advance, or moves while causing the imaging device 28 to read the guiding marks 14*a*.

The care robot 20 turns to the right at the entrance/exit 13*a*1 of the first private room 13*a*, comes out to the corridor 14, turns to the right at the intersection of the corridors 14, turns to the left at the entrance/exit 12*a* of the training room 12, and enters the training room 12. The care robot 20 moves forward while the rear surface of the care robot 20 is oriented in the traveling direction.

If the seating operation for seating the care receiver M1 starts, the care robot 20 brings the care receiver M1 in the standing-upright state (refer to FIG. 9) into a seated state while the upper body of the care receiver M1 is held by the holding unit 23 (refer to FIG. 8). More specifically, as illustrated in FIG. 10, the sitting motion is performed along the sitting trajectory.

Then, if the seating operation ends, the care robot 20 guides the care receiver M1, "please release your hand grip from the handle". If the care receiver M1 releases his or her hand grip from the handle 24, the contact sensors 24*a* and 24*b* detect that his or her hand grips are released from the handle 24. Accordingly, the care robot 20 moves away from the care receiver M1.

In the embodiment, a care robot 20 that includes a holding section 23 configured to assist a standing-upright motion and a sitting motion of a care receiver M1 by supporting a part of the body of the care receiver M1, in which when the sitting care receiver M1 stands upright with the support of the holding section 23, a standing-upright trajectory, along which a movement control portion (for example, shoulder position Ps) of the care receiver M1 moves, is set such that a center G of gravity of the care receiver M1 is present in a range A of the soles of both feet between a point in time early after the start of the standing-upright motion and an end time point of the standing-upright motion of the care receiver M1, in which when the standing care receiver M1 sits with the support of the holding section 23, a sitting trajectory, which is different from the standing-upright trajectory, and along which the movement control portion of the care receiver M1 moves, is set such that the center G of gravity of the care receiver M1 is present out of the range A of the soles of both feet from a point in time early after the start of the sitting motion of the care receiver M1, and moves toward a predetermined sitting position of the care receiver M1.

In this manner, when the care receiver M1 stands upright in such a manner that the movement control portion (for example, the shoulder position Ps) of the care receiver M1 moves along the standing-upright trajectory, similar to when a healthy person stands upright, the center G of gravity enters the range A of the soles of both feet from the point in time early after the start of the standing-upright motion, and then remains in the range A up to the end time point of the standing-upright motion. Accordingly, the care receiver M1 is assisted in standing upright with the same feeling as when the care receiver M1 stands upright without assistance. It is possible to assist the care receiver M1 in standing upright without making the care receiver M1 uncomfortable.

In contrast, when the care receiver M1 sits in such a manner that the movement control portion of the care receiver M1 moves along the sitting trajectory, similar to when a healthy person sits, the center G of gravity leaves the range A of the soles of both feet from the point in time early after the start of the sitting motion, and then moves toward the predetermined sitting position (for example, a seat portion) of the care receiver. Accordingly, the care receiver M1 is assisted in sitting with the same feeling as when the care receiver M1 sits without assistance. It is possible to assist the care receiver M1 in sitting without making the care receiver M1 uncomfortable.

In the standing-upright trajectory, the point in time early after the start of the standing-upright motion may represent a time point when the sitting care receiver M1 leans forward, and lifts his or her waist upward (refer to an upper middle view in FIG. 11). Accordingly, it is possible to more reliably assist the care receiver M1 in standing upright without making the care receiver M1 uncomfortable from when the care receiver M1 leans forward and lifts his or her waist upward to the end time point of the standing-upright motion.

A care robot 20 that includes a holding section 23 configured to assist a standing-upright motion and a sitting motion of a care receiver M1 by supporting a part (the chest) of the body of the care receiver M1, the robot including: a base 21; a robot arm section 22 that is provided in the base 21, and includes multiple arms 22*a*, 22*b*, and 22*c* which are mutually and relatively movable by using a drive section; a holding section 23 that is provided in a distal end portion of the robot arm section 22, and supports the care receiver; a storage device (memory section) 27 that stores standing-upright trajectory reference data indicative of a standing-upright trajectory along which a movement control portion of the care receiver M1 moves when the sitting care receiver M1 stands upright with the support of the holding section 23, and sitting trajectory reference data indicative of a sitting trajectory which is different from the standing-upright trajectory, and along which the movement control portion of the care receiver M1 moves when the standing care receiver M1 sits with the support of the holding section 23; and a drive control section 26*d* configured to drive the drive section such that the robot arm section 22 is driven based on the standing-upright trajectory reference data and the sitting trajectory reference data.

Since the standing-upright trajectory reference data can be easily set to data corresponding to a standing-upright trajectory of a healthy person, when the care receiver M1 is assisted in standing upright in such a manner that the movement control portion (for example, the shoulder position) of the care receiver M1 moves along the standing-upright trajectory, it is possible to drive the robot arm section 22 based on standing-upright trajectory reference data corresponding to the standing-upright trajectory of the healthy person. Accordingly, the care receiver M1 is assisted in standing upright with the same feeling as when the care receiver M1 stands upright without assistance. It is possible to assist the care receiver M1 in standing upright without making the care receiver M1 uncomfortable.

In contrast, typically, a sitting trajectory of a healthy person is different from the standing-upright trajectory thereof; however, since the sitting trajectory reference data can be easily set to data corresponding to the sitting trajectory of the healthy person, when the care receiver M1 is assisted in sitting in such a manner that the movement control portion of the care receiver M1 moves along the sitting trajectory, it is possible to drive the robot arm section 22 based on the sitting trajectory reference data corresponding to the sitting trajectory of the healthy person. Accordingly, the care receiver M1 is assisted in sitting with the same feeling as when the care receiver M1 sits without assistance. It is possible to assist the care receiver M1 in sitting without making the care receiver M1 uncomfortable.

The care robot may further include a correction section 26*c* that corrects the standing-upright trajectory reference data and the sitting trajectory reference data in correspondence with at least one of a body height of the care receiver M1 and the height of a seat portion on which the care receiver M1 sits. The drive control section 26*d* may drive the drive section such that the robot arm section 22 is driven based on the standing-upright trajectory reference data and the sitting trajectory reference data corrected by the correction section 26*c*. Accordingly, even if the body height of the care receiver M1 and the height of the seat portion are changed, it is possible to assist the care receiver M1 in standing upright and sitting along an adequate standing-upright trajectory and sitting trajectory corresponding thereto.

The standing-upright trajectory reference data and the sitting trajectory reference data may be stored while also including an angle α of the holding section 23 at each point in the standing-upright trajectory and the sitting trajectory. The drive control section 26*d* (26) may drive the drive section such that the angle α of the holding section 23 at each point is controlled to become the angle stored in the standing-upright trajectory reference data and the sitting trajectory reference data. Since it is possible to optimally set the angle of the movement control portion (the shoulder position) of the care receiver M1 associated with the holding section 23 at each position on the standing-upright trajectory and the sitting trajectory, it is possible to assist the care receiver M1 in more pleasantly (smoothly) standing upright and sitting.

The storage device (memory section) 27 may store multiple items of standing-upright trajectory data which are indicative of trajectories different from the standing-upright trajectory corresponding to the standing-upright trajectory reference data, and are prepared to train multiple different body parts of the care receiver M1. The care robot may further includes an acquisition section 26*a* that acquires data, corresponding to body parts that the care receiver M1 wants to train, among the multiple items of standing-upright trajectory data. When the sitting care receiver M1 stands upright with the support of the holding section 23, the drive control section 26*d* may drive the robot arm section 22 based on the data acquired by the acquisition section 26*a*. Accordingly, during standing upright, the care receiver M1 can not only stand upright but also train a desired body part by selecting a standing-upright trajectory corresponding to a body part that the care receiver M1 wants to train.

The drive control section 26*d* (26) may perform control such that the velocity of the holding section 23 when the sitting care receiver M1 stands upright with the support of the holding section 23 becomes different from the velocity of the holding section 23 when the standing care receiver M1 sits with the support of the holding section 23. Typically, when a healthy person is not assisted, the healthy person stands upright more slowly than when sitting, and similar to this, a velocity when the care receiver M1 supported by the holding section 23 can be set to be lower than a velocity when sitting. Accordingly, the care receiver M1 is assisted in standing upright or sitting with the same feeling as when a healthy person stands upright or sits. It is possible to assist the care receiver M1 in standing upright and sitting without making the care receiver M1 uncomfortable.

When the sitting care receiver M1 stands upright with the support of the holding section 23, the drive control section 26*d* (26) may control the velocity of the drive section such that the velocity of the holding section 23 becomes a velocity corresponding to a burden on the care receiver M1 in a zone, corresponding to a body part that the care receiver M1 wants to train, among multiple zones in the standing-upright trajectory. Accordingly, when the care receiver M1 stands upright, it is possible to easily adjust a load to a desired body part that the care receiver M1 wants to train.

A holding section 23 is provided in a distal end portion of a robot arm section 22 including multiple arms 22*a*, 22*b*, and 22*c* which are mutually and relatively movable by using a drive section provided in a base 21, and the holding section supports the care receiver. A storage device (memory section) 27 stores standing-upright trajectory reference data indicative of a standing-upright trajectory along which a movement control portion of the care receiver M1 moves when the sitting care receiver M1 stands upright with the support of the holding section 23, and sitting trajectory reference data indicative of a sitting trajectory which is different from the standing-upright trajectory, and along which the movement control portion of the care receiver M1 moves when the standing care receiver M1 sits with the support of the holding section 23. A drive control section 26*d* drives the drive section such that the robot arm section 22 is driven based on the standing-upright trajectory reference data and the sitting trajectory reference data. The standing-upright trajectory is set such that the center G of gravity of the care receiver M1 is present in a range A of the soles of both feet of the care receiver M1 between a point in time early after the start of a standing-upright motion and an end time point of the standing-upright motion of the care receiver M1. The sitting trajectory is set such that the center G of gravity of the care receiver M1 is present out of the range A of the soles of both feet of the care receiver M1 from a point in time early after the start of a sitting motion of the care receiver M1, and moves toward a predetermined sitting position (seat portion) of the care receiver M1.

In this manner, when the care receiver M1 stands upright in such a manner that the movement control portion of the care receiver M1 moves along the standing-upright trajectory, similar to when a healthy person stands upright, the center G of gravity enters the range A of the soles of both feet from the point in time early after the start of the standing-upright motion, and then remains in the range A up to the end time point of the standing-upright motion. Accordingly, the care receiver M1 is assisted in standing upright with the same feeling as when the care receiver M1 stands upright without assistance. It is possible to assist the care receiver M1 in standing upright without making the care receiver M1 uncomfortable.

In contrast, when the care receiver M1 sits in such a manner that the movement control portion of the care receiver M1 moves along the sitting trajectory, similar to when a healthy person sits, the center G of gravity leaves the range A of the soles of both feet from the point in time early after the start of the sitting motion, and then moves toward the predetermined sitting position of the care receiver M1. Accordingly, the care receiver M1 is assisted in sitting with the same feeling as when the care receiver M1 sits without assistance. It is possible to assist the care receiver M1 in sitting without making the care receiver M1 uncomfortable.

Figure 17:
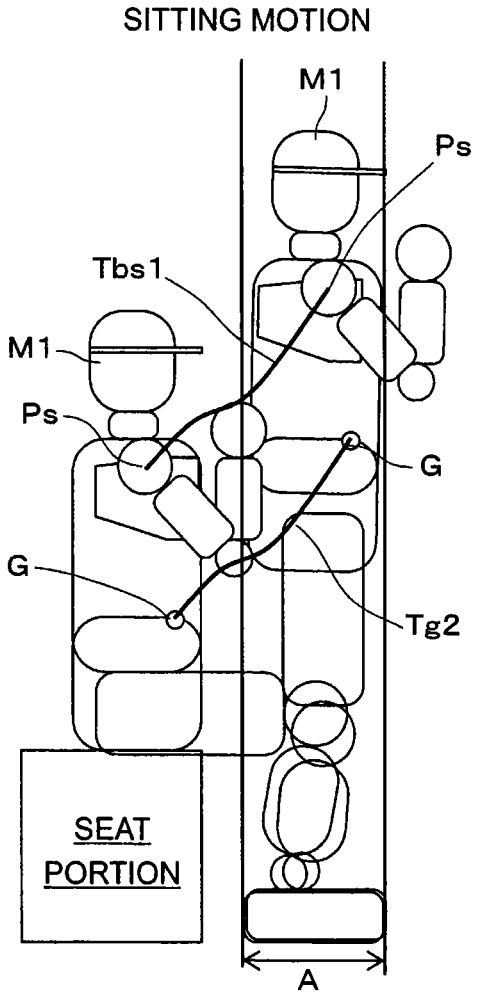
FIG. 17 is a view illustrating an example of another sitting motion.

The above-described sitting trajectory is not limited to that in FIG. 10. For example, FIG. 17 illustrates a sitting trajectory on which the care receiver M1 sits while leaning forward compared to when the case illustrated in FIG. 10. In this case, similar to the case illustrated in FIG. 10, the sitting trajectory is also positioned below a standing-upright trajectory, and the center of gravity of the care receiver M1 leaves the range A of the soles of both feet of the care receiver M1 from the point in time early after the start of the sitting motion of the care receiver M1.

REFERENCE SIGNS LIST

10: CARE CENTER, 11: STATION, 12: TRAINING ROOM, 13*a* to 13*d*: FIRST TO FOURTH PRIVATE ROOMS, 14: CORRIDOR, 20: CARE ROBOT, 21: BASE, 21*g*, 21*h*: LEFT AND RIGHT DRIVE WHEEL MOTORS (DRIVE SOURCE), 22: ROBOT ARM SECTION, 22*a*: FIRST ARM, 22*a*1*c* FIRST ROTATION-PURPOSE MOTOR (DRIVE SECTION), 22*a*2*b*: SLIDE-PURPOSE MOTOR (DRIVE SECTION), 22*b*: SECOND ARM, 22*b*3: SECOND ROTATION-PURPOSE MOTOR (DRIVE SECTION), 22*c*: THIRD ARM, 23: HOLDING SECTION, 24: HANDLE, 25: OPERATION DEVICE, 26: CONTROL DEVICE, 26*a*: REFERENCE DATA ACQUISITION SECTION, 26*b*: BODY-HEIGHT AND CHAIR-HEIGHT ACQUISITION SECTION, 26*c*: CORRECTION SECTION, 26*d*: DRIVE CONTROL SECTION, 27: STORAGE DEVICE, 28: IMAGING DEVICE, 29: GUIDE DEVICE, M1: CARE RECEIVER, M2: CAREGIVER.

The invention claimed is:

1. A care robot, comprising:

a holding section configured to assist a standing-upright motion and a sitting motion of a care receiver by supporting a part of the body of the care receiver;

a base;

a robot arm section that is provided in the base, and includes multiple arms which are mutually and relatively movable by using a drive section;

the holding section that is provided in a distal end portion of the robot arm section, and supports the care receiver;

a memory section that stores standing-upright trajectory reference data of the holding section, and sitting trajectory reference data of the holding section which is different from the standing-upright trajectory, and along which the movement control portion of the care receiver moves when the care receiver sits with the support of the holding section;

a handle configured to be gripped by hands of the care receiver, the handle including a first contact sensor to detect a first hand of the care receiver and a second contact sensor to detect a second hand of the care receiver; and a drive control section configured to drive the drive section such that the robot arm section is driven based on the standing-upright trajectory reference data and the sitting trajectory reference data, wherein when the sitting care receiver stands upright with the support of the holding section, a standing-upright trajectory of the holding section, is set, wherein when the standing care receiver sits with the support of the holding section, a sitting trajectory of the holding section, which is different from the standing-upright trajectory, is set, wherein the sitting trajectory of the holding section is above the standing-upright trajectory of the holding section, and wherein the holding section performs the standing-upright motion when the first contact sensor detects the first hand, in response to a first guidance by the care robot.

2. The care robot according to claim 1, further comprising:

a correction section that corrects the standing-upright trajectory reference data and the sitting trajectory reference data in correspondence with a body height of the care receiver and a height of a seat portion on which the care receiver sits, wherein the drive control section drives the drive section such that the robot arm section is driven based on the standing-upright trajectory reference data and the sitting trajectory reference data corrected by the correction section.

3. The care robot according to claim 1, wherein the standing-upright trajectory reference data and the sitting trajectory reference data are stored while also including an angle of the holding section at each point in the standing-upright trajectory and in the sitting trajectory, and wherein the drive control section drives the drive section such that the angle of the holding section at each point is controlled to become the angle stored in the standing-upright trajectory reference data and the sitting trajectory reference data.

4. The care robot according to claim 1, wherein the memory section stores multiple items of standing-upright trajectory data which are indicative of trajectories different from the standing-upright trajectory corresponding to the standing-upright trajectory reference data, and are prepared to train multiple different body parts of the care receiver, and wherein the care robot further comprises:

an acquisition section that acquires data, corresponding to the body parts that the care receiver wants to train, among the multiple items of standing-upright trajectory data, wherein when the care receiver stands upright with the support of the holding section, the drive control section drives the robot arm section based on the data acquired by the acquisition section.

5. The care robot according to claim 1, wherein the drive control section performs control such that a velocity of the holding section when the care receiver stands upright with the support of the holding section becomes different from a velocity of the holding section when the care receiver sits with the support of the holding section.

6. The care robot according to claim 5, wherein when the care receiver stands upright with the support of the holding section, the drive control section controls the velocity of the drive section such that the velocity of the holding section becomes a velocity corresponding to a burden on the care receiver in a zone where the care receiver wants to train, among multiple zones in the standing-upright trajectory.

7. The care robot according to claim 1, wherein after completion of the standing-upright motion a second guidance is issued by the care robot, and wherein the care robot moves away from the care receiver by a predetermined distance when the first contact sensor detects a release of the handle by the first hand and the second contact sensor detects a release of the handle by the second hand, each in response to the second guidance.

8. A care robot, comprising:

a holding section configured to assist a standing-upright motion and a sitting motion of a care receiver by supporting a part of the body of the care receiver, wherein when the sitting care receiver stands upright with the support of the holding section, a standing-upright trajectory of the holding section is set such that a center of gravity of the care receiver is present in the range of the soles of both feet between a point in time early after the start of the standing-upright motion and an end time point of the standing-upright motion of the care receiver, wherein when the standing care receiver sits with the support of the holding section, a sitting trajectory of the holding section, which is different from the standing-upright trajectory, is set such that the center of gravity of the care receiver is present out of the range of the soles of both feet from a point in time early after the start of the sitting motion of the care receiver, and moves toward a predetermined sitting position of the care receiver, wherein the sitting trajectory of the holding section is above the standing-upright trajectory of the holding section.

9. The care robot according to claim 8, wherein in the standing-upright trajectory, the point in time early after the start of the standing-upright motion represents a time point when the sitting care receiver leans forward, and lifts his or her waist upward.

10. A care robot, comprising:

a holding section configured to assist a standing-upright motion and a sitting motion of a care receiver by supporting a part of the body of the care receiver, wherein when the sitting care receiver stands upright with the support of the holding section, a standing-upright trajectory of the holding section is set, wherein when the standing care receiver sits with the support of the holding section, a sitting trajectory of the holding section, which is different from the standing-upright trajectory, is set, wherein the standing-upright trajectory of the holding section is above the sitting trajectory of the holding section.

* * * * *